US008056163B2

(12) United States Patent
Lemire et al.

(10) Patent No.: US 8,056,163 B2
(45) Date of Patent: Nov. 15, 2011

(54) PATIENT SUPPORT

(75) Inventors: Guy Lemire, Beamont (CA); Martin W. Stryker, Kalamazoo, MI (US); Pascal Castonguay, Levis (CA)

(73) Assignee: Stryker Corporation, Kalamazoo, MI (US)

( * ) Notice: Subject to any disclaimer, the term of this patent is extended or adjusted under 35 U.S.C. 154(b) by 918 days.

(21) Appl. No.: 11/769,959

(22) Filed: Jun. 28, 2007

(65) Prior Publication Data

US 2008/0000028 A1 Jan. 3, 2008

Related U.S. Application Data

(60) Provisional application No. 60/817,528, filed on Jun. 28, 2006, provisional application No. 60/830,397, filed on Jul. 11, 2006.

(51) Int. Cl.
*A61G 13/04* (2006.01)

(52) U.S. Cl. ..... 5/611; 5/610; 5/618; 5/617

(58) Field of Classification Search ..... 5/600, 610, 5/611, 617, 618
See application file for complete search history.

(56) References Cited

U.S. PATENT DOCUMENTS

| | | | | |
|---|---|---|---|---|
| 1,482,439 | A | | 2/1924 | McCollough |
| 2,127,309 | A | | 8/1938 | Rickard |
| 2,504,324 | A | | 4/1950 | Goldstein |
| 2,522,759 | A | | 9/1950 | Lindquist |
| 3,302,219 | A | | 2/1967 | Harris |
| 3,311,933 | A | | 4/1967 | Peterson |
| 3,465,373 | A | | 9/1969 | Wilson |
| 3,742,527 | A | | 7/1973 | Johnson et al. |
| 3,790,133 | A | | 2/1974 | Jones |
| 3,814,414 | A | * | 6/1974 | Chapa ..... 5/601 |
| 4,175,550 | A | * | 11/1979 | Leininger et al. ..... 601/5 |
| 4,227,269 | A | | 10/1980 | Johnston |
| 4,376,317 | A | | 3/1983 | Johnson |
| 4,409,695 | A | | 10/1983 | Johnson et al. |
| 4,631,761 | A | | 12/1986 | Lederman |
| 4,872,657 | A | | 10/1989 | Lussi |
| 4,894,876 | A | | 1/1990 | Fenwick |
| 5,095,560 | A | | 3/1992 | Volker |
| 5,112,076 | A | | 5/1992 | Wilson |

(Continued)

FOREIGN PATENT DOCUMENTS

WO WO0147340 7/2001

*Primary Examiner* — Michael Trettel
*Assistant Examiner* — William Kelleher
(74) *Attorney, Agent, or Firm* — Warner Norcross & Judd LLP

(57) ABSTRACT

A patient support apparatus, such as a bed, stretcher, or cot, includes a patient support deck that is directly coupled to elevation adjustment mechanisms without the need for an intervening frame. The elevation adjustment mechanisms may be placed outside the perimeter of the support deck to allow the support deck to be lowered to a greater extent and provide room for attaching side rails to the support deck. The width of the patient support deck may be adjusted by way of extenders, and the sleep surface may also be adjusted by way of foldable strips. A jack type of actuator may be used to pivot the different sections of the support deck with respect to each other. The elevation adjustment mechanisms may include vertical threaded shafts that rotatingly engage threaded collars and raise or lower the collars when the shaft and the collar rotate with respect to each other.

20 Claims, 33 Drawing Sheets

U.S. PATENT DOCUMENTS 5,129,116 A 7/1992 Borders et al.
5,134,731 A 8/1992 Quintile et al.
5,172,442 A 12/1992 Bartley et al.
5,230,112 A 7/1993 Harrawood et al.
5,317,769 A 6/1994 Weismiller et al.
5,343,581 A 9/1994 Bartley et al.
5,461,739 A 10/1995 Falbo, Sr.
5,461,740 A * 10/1995 Pearson ..... 5/611
5,577,279 A 11/1996 Foster et al.
5,636,394 A 6/1997 Bartley
5,774,915 A 7/1998 Scott et al.
5,894,966 A 4/1999 Bobey et al.
5,996,145 A 12/1999 Taylor
6,038,718 A 3/2000 Pennington et al.
6,112,345 A 9/2000 Foster et al.
6,131,215 A 10/2000 Lindell
6,141,806 A 11/2000 Bobey et al.
6,260,220 B1 * 7/2001 Lamb et al. ..... 5/607
6,282,736 B1 9/2001 Hand et al.
6,357,065 B1 3/2002 Adams
6,502,261 B1 1/2003 Harwood
6,505,363 B2 1/2003 Davis
6,505,365 B1 * 1/2003 Hanson et al. ..... 5/613
6,516,479 B1 2/2003 Barbour
6,536,056 B1 3/2003 Vrzalik et al.
6,678,907 B1 1/2004 Voelker et al.
6,681,423 B2 1/2004 Zachrisson
6,694,557 B1 2/2004 Bobey et al.
6,779,210 B1 8/2004 Kelly
6,822,571 B2 11/2004 Conway
6,848,127 B2 2/2005 Inagaki
6,880,187 B1 4/2005 Johnson
6,904,631 B2 6/2005 Vrzalik et al.
6,978,501 B2 12/2005 Vrzalik
7,111,340 B2 9/2006 Mitchell et al.
7,140,054 B2 11/2006 Charles
7,152,261 B2 * 12/2006 Jackson ..... 5/600
7,181,791 B2 2/2007 Clayton
7,343,635 B2 * 3/2008 Jackson ..... 5/611
7,565,708 B2 * 7/2009 Jackson ..... 5/611
7,600,281 B2 * 10/2009 Skripps ..... 5/621
2003/0000015 A1 1/2003 Horlin
2004/0133983 A1 * 7/2004 Newkirk et al. ..... 5/624
2004/0143904 A1 7/2004 Borders et al.
2005/0015877 A1 1/2005 Qi
2005/0015878 A1 1/2005 Bannister et al.
2005/0125899 A1 6/2005 Hanson et al.
2005/0210579 A1 9/2005 Moffa et al.
2005/0229321 A1 10/2005 Phillips et al.
2005/0273932 A1 12/2005 Horlin
2006/0000021 A1 1/2006 Hayes et al.
2006/0021143 A1 2/2006 Lemire
2006/0059623 A1 3/2006 Karmer, Jr. et al.
2006/0085914 A1 4/2006 Peterson et al.
2006/0090260 A1 5/2006 Stryker et al.
2006/0090261 A1 5/2006 Vrzalik
2006/0117484 A1 6/2006 Derenne et al.
2006/0168728 A1 8/2006 Stobel et al.
2006/0195984 A1 9/2006 Hakamiun et al.
2006/0195986 A1 9/2006 Hakamiun et al.
2006/0253983 A1 11/2006 Falabrino
2007/0000055 A1 1/2007 Donaldson
2007/0192960 A1 * 8/2007 Jackson ..... 5/618

* cited by examiner

PATIENT SUPPORT

CROSS-REFERENCE TO RELATED APPLICATIONS

This application claims priority to U.S. provisional patent application Ser. No. 60/817,528, filed Jun. 28, 2006 by applicants Guy Lemire and Patrick Lafleche, and entitled Modular Patient Support, the entire contents of which is hereby expressly incorporated herein by reference. This application also claims priority to U.S. provisional patent application Ser. No. 60/830,397 filed Jul. 11, 2006 by applicant Guy Lemire, and entitled Patient Support with Hi-Lo Mechanisms Located in Head and Foot-end Vertical Support Frames, the entire contents of which is hereby expressly incorporated herein by reference.

BACKGROUND OF THE INVENTION

The present invention relates generally to patient support apparatuses, such as beds, stretchers, cots, and the like, and more particularly to patient support apparatuses that can have their height and orientations changed.

SUMMARY OF THE INVENTION

The present invention offers an improved patient support apparatus that can have its height adjusted to a greater extent than prior patient support apparatuses, that can support greater weight loads, that can accommodate a variety of different side rails, that can work in tandem with an overhead proning mechanism, that can have the width or length of its patient support area easily adjusted, and that can achieve a variety of additional advantageous objectives.

According to one aspect of the present invention, a patient support apparatus is provided that includes a base, first and second elevation mechanisms, a support deck, first and second rails, and an actuator. The base includes a foot end and a head end. The first elevation assembly is positioned at the head end of the base, and the second elevation assembly is positioned at the foot end of the base. The support deck supports a patient and is coupled to the first and second elevation assemblies such that the first and second elevation assemblies can raise and lower the support deck with respect to the base. The first rail is part of the support deck and extends from the head end of the base to an intermediate location between the foot end and the head end of the base. The first rail includes a head end pivotably coupled to the first elevation assembly. The second rail is part of the support deck and extends from the foot end of the base to the intermediate location. The second rail is pivotably coupled to the first rail and has a foot end pivotably coupled to the second elevation assembly. At least one of the first and second rails includes a beam and a sleeve wherein the beam and the sleeve each having longitudinal extents that are parallel to each other, and the beam and the sleeve are adapted to move with respect to each other such that a length of one of the first and second rails can be extended and shortened. The actuator is adapted to pivot the first rail with respect to the second rail such that the beam and the sleeve move with respect to each other and a horizontal distance between the head end of the first rail and the foot end of the second rail remains constant while the first rail pivots with respect to the second rail.

According to another aspect of the present invention, a patient support apparatus is provided that includes a base, a support deck, first and second elevation assemblies, and a shear reduction assembly. The base includes a head end and a foot end. The support deck is adapted to support a patient and includes a foot section, a seat section, and a head section. Both the seat section and the head section are pivotable between generally horizontal orientations and raised orientations. The first elevation assembly is positioned at the head end of the base. The second elevation assembly is positioned at the foot end of the base. The first and second elevation assemblies are coupled to the support deck such that they can raise and lower the support deck with respect to the base. The first and second elevation assemblies are positioned outside a footprint of the support deck wherein the footprint is defined by a vertical downward projection of the perimeter of the support deck onto the base. The shear reduction assembly is adapted to increase a distance between the head section and the seat section when the head section and the seat section are pivoted from their respective generally horizontal orientations to their respective raised orientations.

According to another aspect of the present invention, a patient support apparatus is provided that includes a base, four vertical threaded shafts, four threaded collars, a head end horizontal beam, a foot end horizontal beam, a support deck, a threaded horizontal shaft, and two sets of arms. The base includes a foot end, a head end, and a plurality of corners. The four vertical threaded shafts are each in engagement with one of the threaded collars such that the collars move vertically upward or downward when the shaft rotates with respect to the collar. One of the vertical shafts is positioned in each of the corners of the base. The head end horizontal beam extends between the two collars at the head end of the base, and the foot end horizontal beam extends between the two collars at the foot end of the base. The support deck supports a patient and is coupled to the head end and foot end horizontal beams. The support deck includes a head section, a seat section, and a foot section. The threaded horizontal shaft is oriented perpendicular to an imaginary line running from the head end of the base to the foot end of the base. Each of the arms in the first set of arms includes a first end threadingly mated to the horizontal shaft and a second end pivotably coupled to an underside of the foot section. Each of the arms in the second set of arms includes a first end threadingly mated to the horizontal shaft and a second end pivotably coupled to the support deck at a location under one of the seat and head sections.

According to still other aspects of the present invention, a plurality of side rails may be attached to the patient support apparatus that are pivotable between first and second orientations that are perpendicular with respect to each other. The perpendicular orientations may be horizontal and vertical orientations, or they may be both vertical orientations. The support deck may include slideable extensions for altering the width of the support deck to better accommodate patients of different sizes. The sleep surface positioned on top of the support deck may also be width-adjustable by including one or more strips that can be unfolded to expand the width of the sleep surface. An overhead support may be provided that lifts a sleeve in which the patient is enveloped to thereby facilitate the turning over of the patient while on the patient support apparatus. The patient's weight may be determined by only a pair of load cells positioned on the patient support apparatus. The patient support apparatus may include one or more posts at its corners that help fill in any gaps that would otherwise be created between the headboard and the adjacent side rails, or the footboard and adjacent side rails.

The various aspects of the present invention provide an improved patient support apparatus that can be used in both bariatric and non-bariatric settings. By coupling the support deck directly to the elevation adjustment assemblies without an intervening frame, substantial weight and cost reductions are achieved. Further, by placing the elevation adjustment assemblies outside the perimeter of the patient support deck, the support deck can be lowered to a greater extent because it is not blocked from downward movement by the structure of the elevation adjustment assemblies. The adjustability of the side rails allows them to be easily moved out of the way when transferring a patient to or from the bed. These and other advantages and features of the present invention will be apparent to one skilled in the art in light of the following written description and the accompanying drawings.

DETAILED DESCRIPTION OF THE INVENTION

Figure 1:
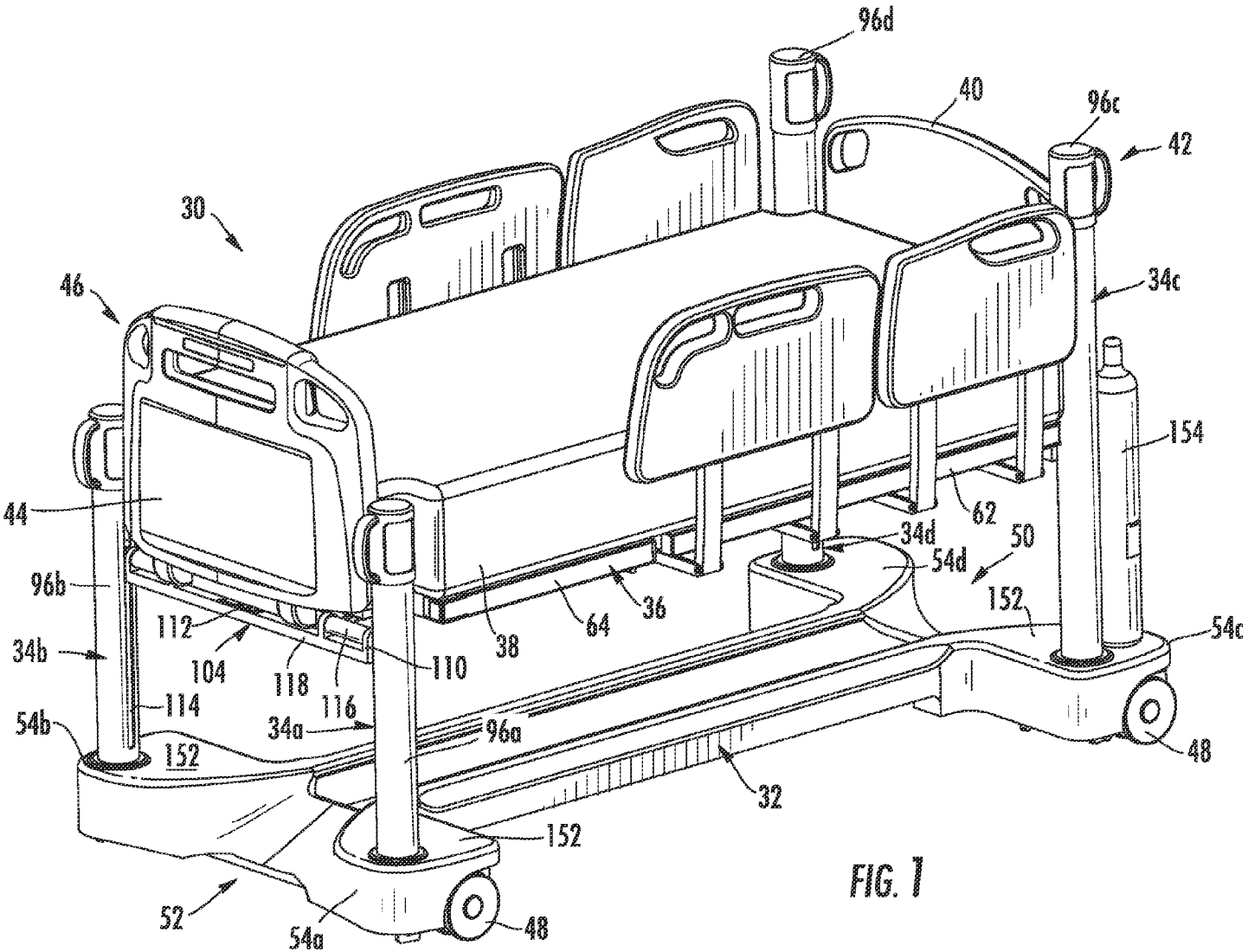
FIG. 1 is a perspective view of a patient support apparatus according to a first embodiment of the present invention.

The present invention will now be described with reference to the accompanying drawings wherein the reference numerals appearing in the following written description correspond to like-numbered elements in the several drawings. A patient support apparatus 30 according to one aspect of the present invention is illustrated in FIG. 1. Patient support apparatus 30 includes a base 32, four elevation assemblies 34*a-d*, a patient support deck 36, a sleep surface 38, a headboard 40 positioned at a head end 42 of patient support apparatus 30, and a footboard 44 positioned at a foot end of patient support apparatus 30. Base 32 includes a plurality of wheels 48 and has a head end 50 and a foot end 52, both of which are oriented in the same direction as head end 42 and foot end 46, respectively, of patient support apparatus 30. Base 32 further includes four corners 54*a-d*, each of which supports one of the elevation assemblies 34*a-d*. The four elevation assemblies 34*a-d* are adapted to raise and lower patient support deck 36 to different heights with respect to base 32. The detailed construction of the elevation assemblies will be described below with reference to FIGS. 5 & 6.

Figure 2:
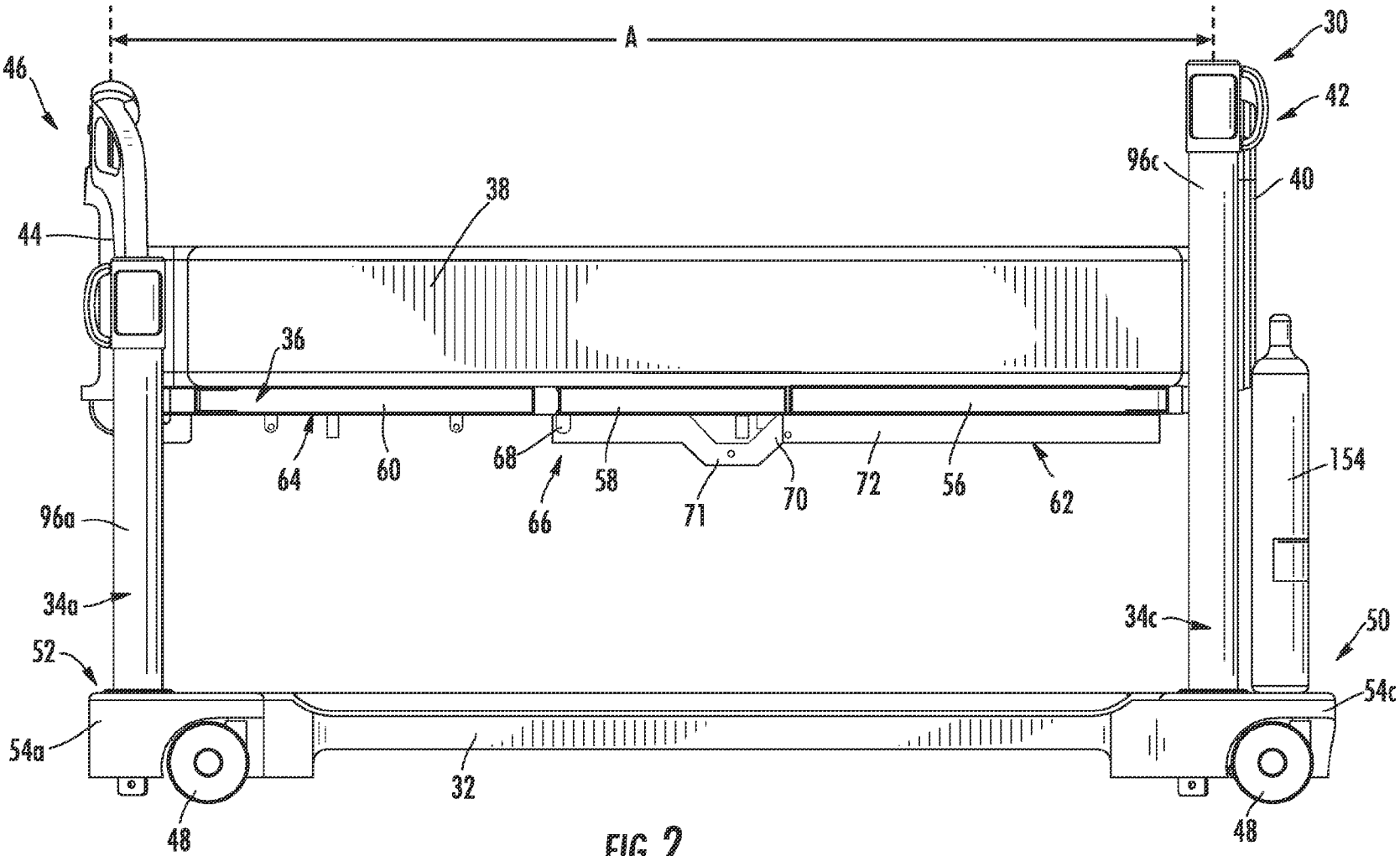
FIG. 2 is a side, elevational view of the patient support apparatus of FIG. 1.
Figure 3:
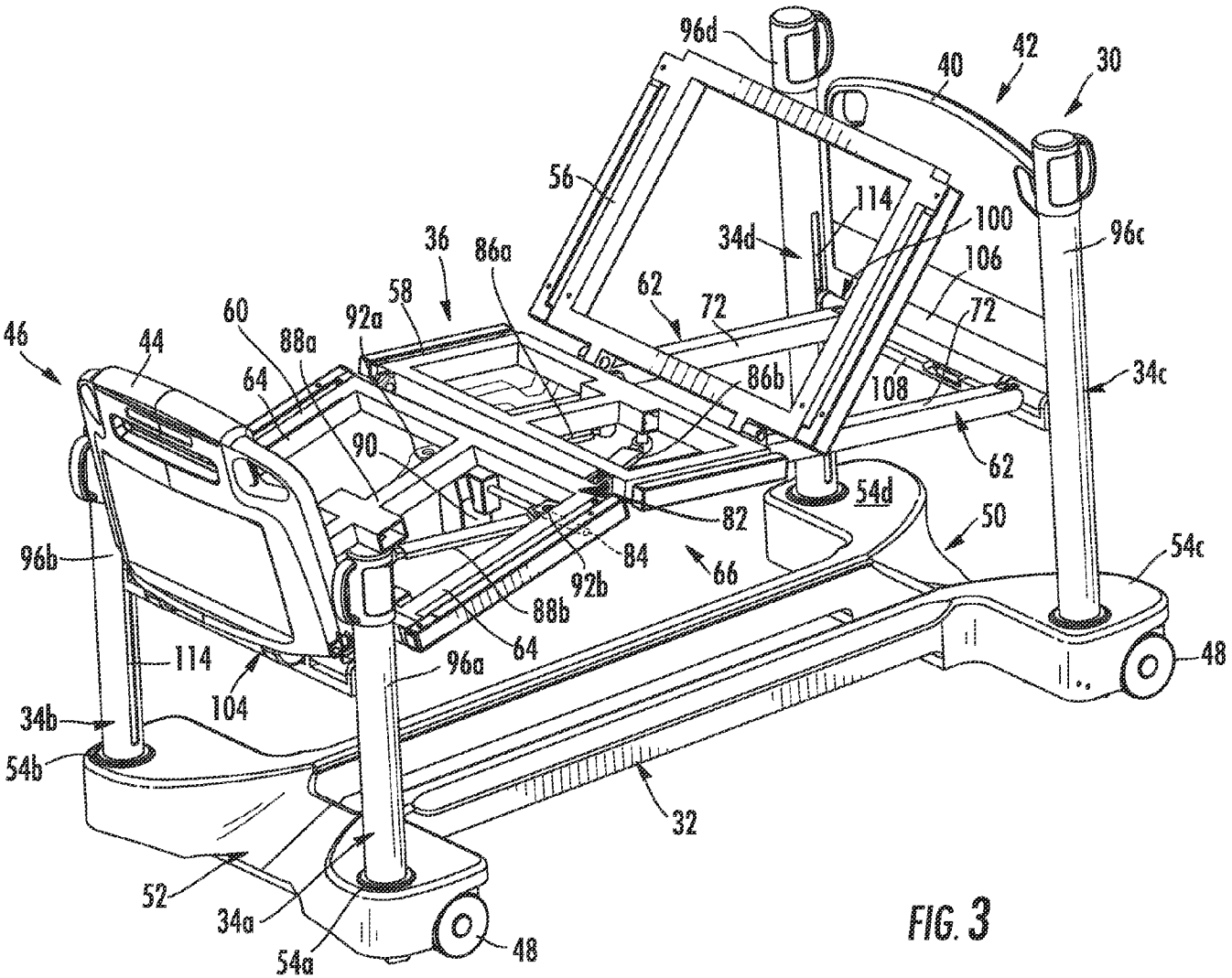
FIG. 3 is a perspective view of the patient support apparatus of FIG. 1 illustrated with the side rails and a sleep surface removed and showing a patient support deck pivoted to a raised orientation.
Figure 4:
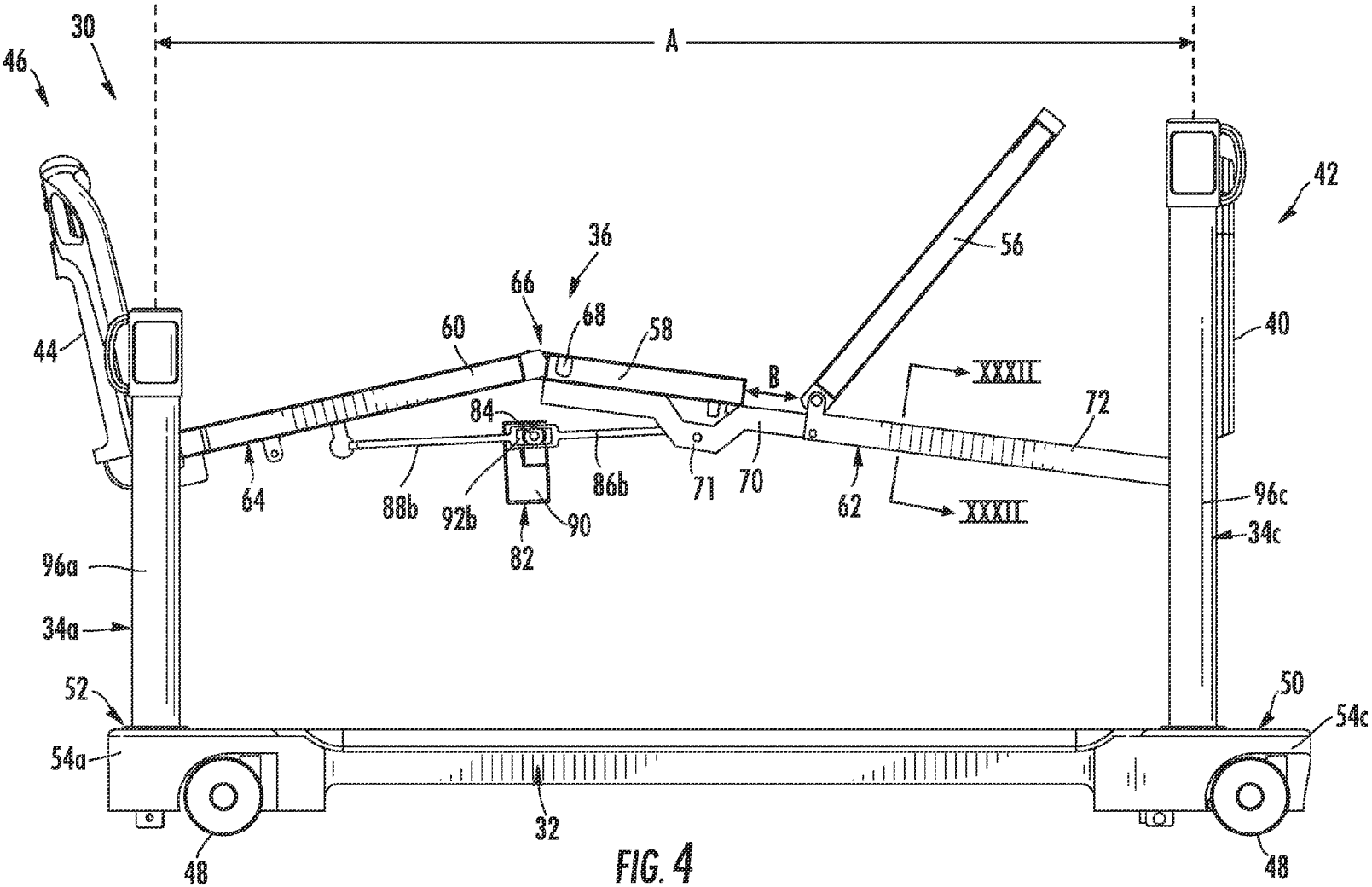
FIG. 4 is a side, elevational view of the patient support apparatus of FIG. 3.

As is more clearly illustrated in FIGS. 2-4, patient support deck 36 is divided into a plurality of sections, including a head section 56, a seat section 58, and a foot section 60. Each section may include a plate (not shown) or other flat structure positioned on top of it that helps support a mattress or other type of sleep surface on which a patient lies. Head section 56 is configured to support the head and torso region of a patient lying on support deck 36. Seat section 58 is configured to support the buttocks region of a patient lying on support deck 36. And foot section 60 is configured to support the foot and lower leg region (e.g. the region of the leg below the knee) of a patient lying on support deck 36. It will be understood, however, that the precise line of demarcation between the various deck sections 56, 58, and 60 can be varied within the present invention to align with different portions of the patient's body. Further, patient support deck 36 can be varied to include a lesser or greater number of deck sections than the three illustrated in FIGS. 2-4.

As can be seen more clearly in FIGS. 3 and 4, patient support deck 36 is supported by way of a pair of head end rails 62 and a pair of foot end rails 64. Each head end rail 62 extends from head end 42 of patient support apparatus 30 to an intermediate location 66 located between head end 42 and foot end 46 of patient support apparatus 30. Each foot end rail 64 extends from foot end 46 of patient support apparatus 30 to intermediate location 66. Head end rails 62 and foot end rails 64 are pivotably coupled to each other at intermediate location 66 by way of one or more pivot pins 68 (FIG. 4).

Figure 12:
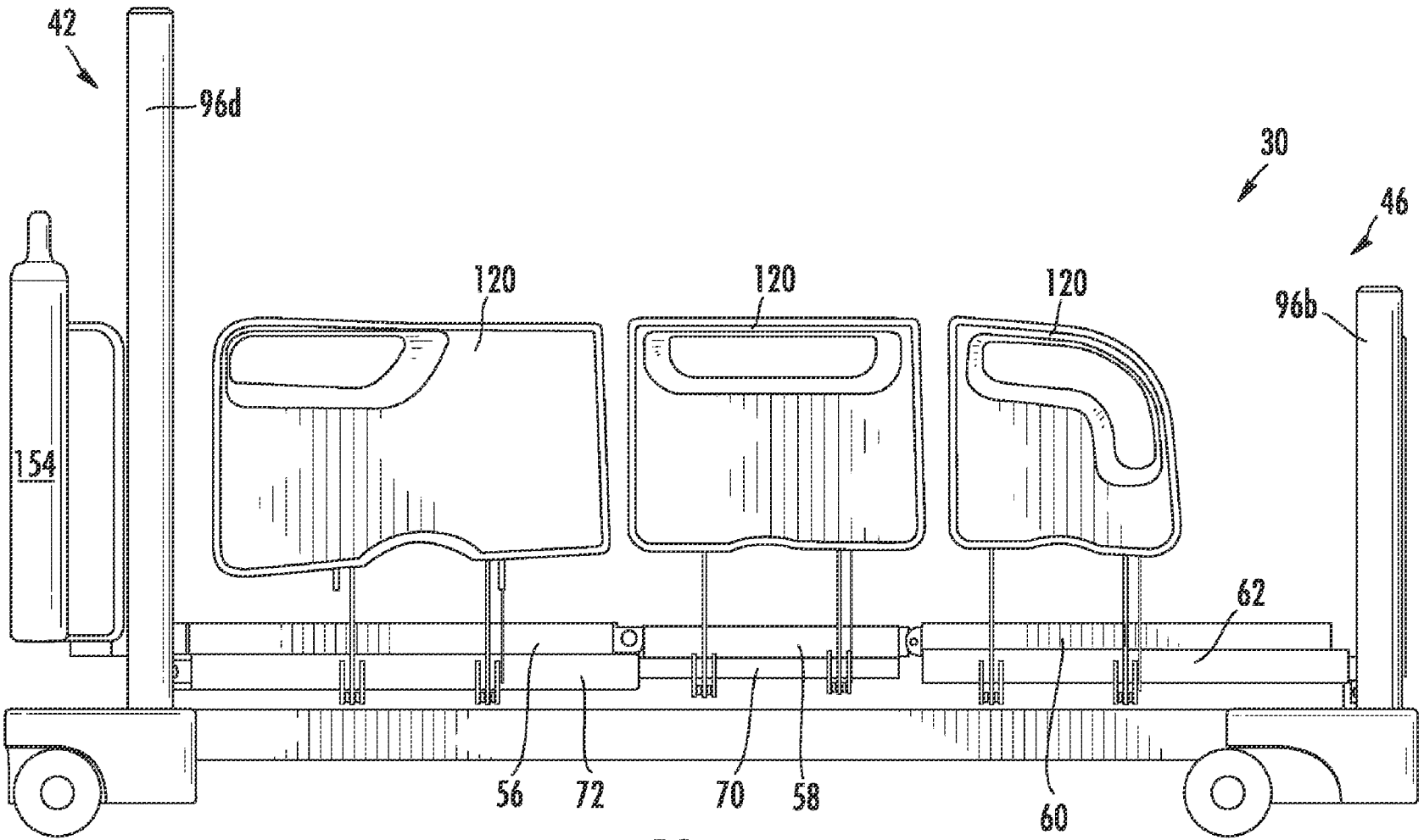
FIG. 12 is a side, elevational view of the patient support apparatus of FIG. 1 illustrating three side rails attached in the upright position.
Figure 13:
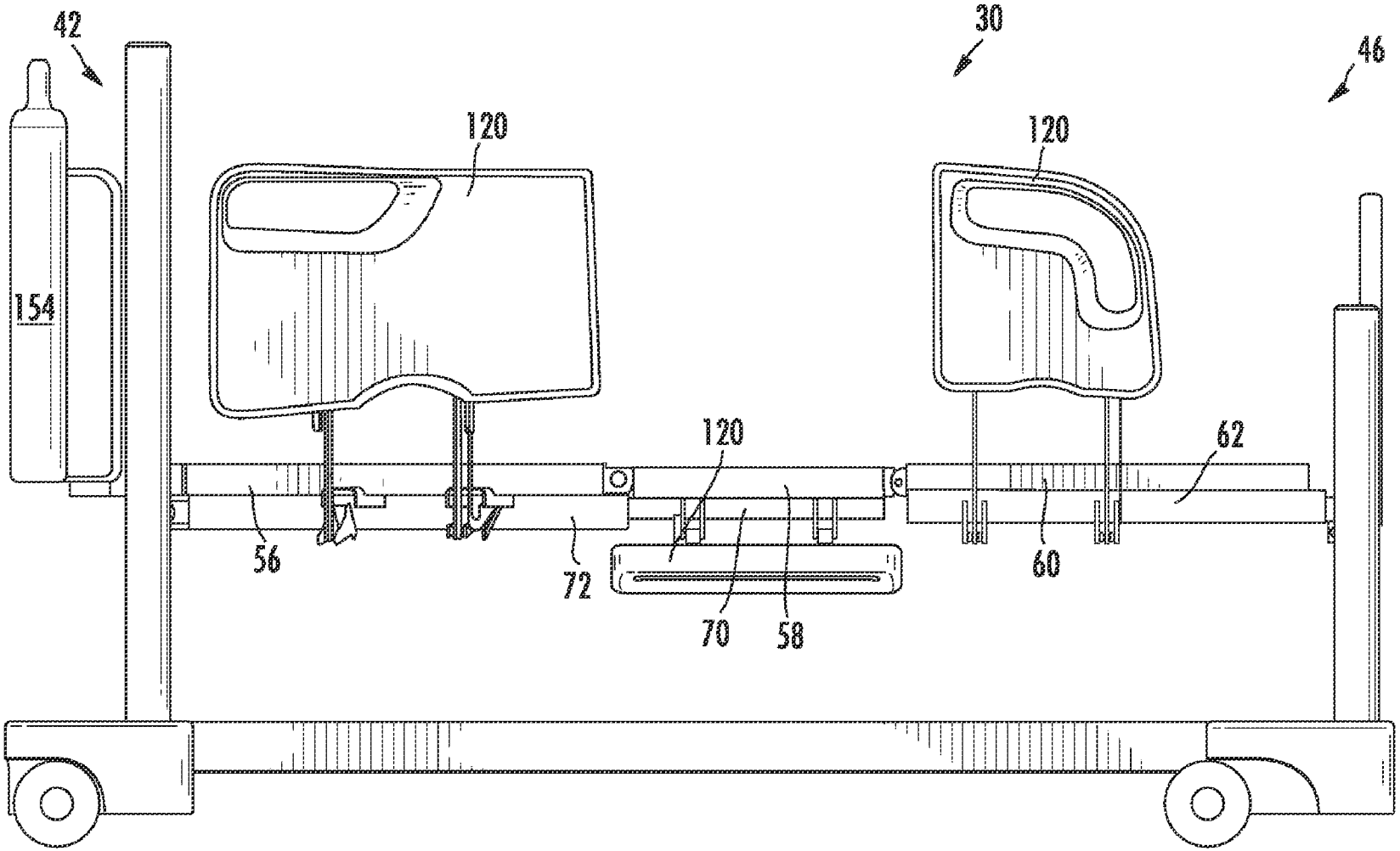
FIG. 13 is a side, elevational view of the patient support apparatus of FIG. 1 illustrating two side rails in the upright position and one in the stowed position.
Figure 32C:
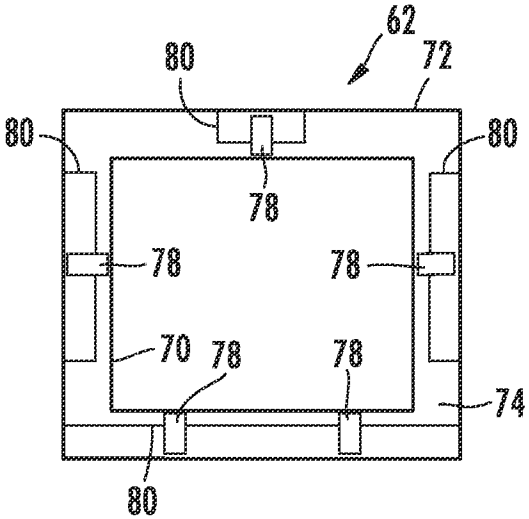
FIGS. 32*a-c* are sectional views of a head end rail taken along the line XXXII-XXXII of FIG. 4 illustrating alternative constructions of the head end rail.
Figure 32B:
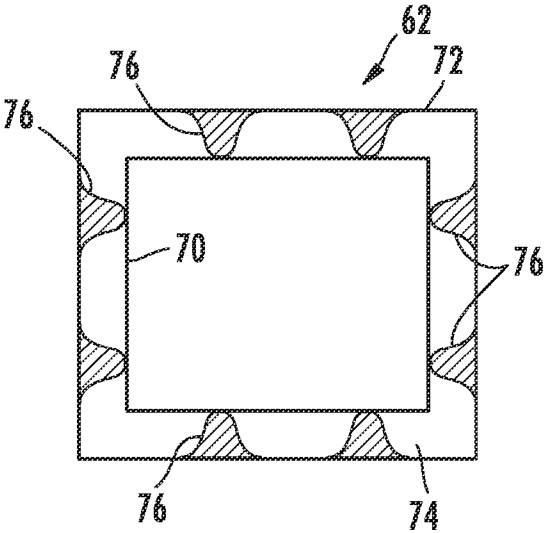
Figure 32A:
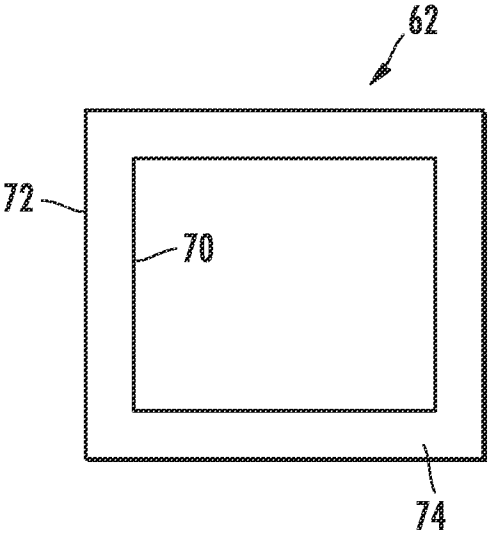

In the embodiment illustrated in FIGS. 3 and 4, each foot end rail 64 is constructed of a rigid, non-extensible beam, while each head end rail 62 is comprised of a beam 70 and a sleeve 72. (Foot end rail 64 could also, or alternatively, be constructed of a beam and sleeve like that of beam 70 and sleeve 72, if desired). Beam 70 and sleeve 72 each extend in longitudinal directions that are parallel to each other. Beam 70 is slideably received within sleeve 72 such that beam 70 can retract into or extend out of sleeve 72, thereby altering the overall length of head end rail 62. Beam 70 may include a bent region 71, such as is shown in FIG. 2, or it may be completely straight, such as is shown in FIGS. 12 and 13. In addition to the varying shapes of beam 70, the manner in which sleeve 72 interacts with beam 70 can be varied widely within the scope of the present invention. FIGS. 32*a-c*, which are cross sections of one of the head end rails 62 of FIG. 4, illustrate three different possible configurations of beam 70 and sleeve 72, although additional configurations can also be used.

In FIG. 32*a*, beam 70 is completely enveloped by sleeve 72 and no mechanical structures are positioned between the outside perimeter of beam 70 and the inside perimeter of sleeve 72 (the distance between these two perimeters is exaggerated for clarity in FIG. 32*a*). A suitable lubricant may be optionally be inserted into a space 74 defined between the exterior of beam 70 and the interior of sleeve 72 to facilitate the sliding of beam 70 with respect to sleeve 72.

In an alternative arrangement illustrated in FIG. 32*b*, one of beam 70 and sleeve 72 can include a plurality of raised bearings 76 in space 74 that provide limited contact between beam 70 and sleeve 72 to thereby facilitate sliding of beam 70 with respect to sleeve 72. While FIG. 32*b* illustrates sleeve 72 as including the raised bearings 76, the raised bearings could alternatively be attached to beam 70. Further, the location, number, and shape of the raised bearing 76 can be varied from that depicted in FIG. 32*c*.

In another alternative arrangement depicted in FIG. 32*c*, a plurality of rollers 78 are sandwiched between beam 70 and sleeve 72 in space 74. Rollers 78 may be spherical rollers, cylindrical rollers, or other types of rollers. Rollers 78 may be held in place by one or more bearing races 80. The number and location of rollers 78, as well as the number, location, and configuration of bearing races 80, can be varied from that depicted in FIG. 32*c*.

In addition to the configurations illustrated in FIGS. 32*a-c*, beam 70 and sleeve 72 can be moveably coupled to each other in still other manners. As one example, sleeve 72 could be constructed to only partially envelope beam 70. As another example, the rectangular cross-sectional shape of beam 70 and sleeve 72 could be varied to circular, square, or other shapes. Still other variations of beam 70 and sleeve 72 can be implemented.

As was noted above, head end rail 62 is pivotably coupled to foot end rail 64. More specifically, in the embodiment illustrated in FIGS. 3 and 4, foot end rail 64 is pivotably coupled to beam 70 of head end rail 62. The pivoting of head end rail 62 with respect to foot end rail 64 is carried out by an actuator 82 (FIGS. 3 and 4). In accordance with at least one aspect of the present invention, actuator 82 may take on any configuration that enables head end rails 62 and foot end rails 64 to pivot with respect to each other. In accordance with another aspect of the present invention, actuator 82 may be configured in the manner illustrated in FIGS. 3 and 4.

In the embodiment illustrated in FIGS. 3 and 4, actuator 82 includes a horizontal threaded shaft 84 to which a first pair of arms 86*a,b* and a second pair of arms 88*a,b* are attached. Horizontal threaded shaft 84 is powered to rotate by a motor 90. First arms 86*a* and *b* are each attached at their foot end (i.e. the end closest to foot end 46 of patient support apparatus 30) to one of collars 92*a* and *b*, respectively. Second arms 88*a* and *b* are each attached at their head end (i.e. the end closest to head end 42 of patient support apparatus 30) to one of collars 92*a* and *b*, respectively. Collars 92*a* and *b* each include one or more internal threaded apertures that matingly couple to the exterior threads on horizontal threaded shaft 84. Collars 92*a* and *b* thereby threadingly mate arms 86*a,b* and 88*a,b* to horizontal threaded shaft 84. The head ends of first arms 86*a* and *b* are pivotably secured to any suitable locations underneath seat section 58 of support deck 36. The foot ends of second arms 88*a* and *b* are pivotably secured to any suitable locations underneath foot section 60 of support deck 36.

In general, actuator 82 operates in the same manner as a conventional car jack, which multiplies the torque of motor 90 such that an enormous pivoting force can be created between seat section 58 and foot section 60, thereby allowing patient support apparatus 30 to sustain greater patient loads. More specifically, the operation of motor 90 causes threaded shaft 84 to turn in either of two directions. In a first direction, the rotation of threaded shaft 84 causes collars 92*a* and *b* to move horizontally toward each other along the axis defined by shaft 84. In the second, opposite direction, the rotation of threaded shaft 84 causes collars 92*a* and *b* to move horizontally away from each other along the axis defined by shaft 84. When collars 92*a* and *b* move toward each other, the angle defined between first arm 86*a* and second arm 88*a* increases (along with the angle defined between first arm 86*b* and second arm 88*b*), causing the distance between the head ends of first arms 86*a* and *b* and the foot ends of second arms 88*a* and *b* to increase, thereby urging seat section 58 and foot section 60 toward the horizontal orientation. In contrast, when collars 92 and *b* move away from each other, the angle defined between first arm 86*a* and second arm 88*a* decreases (along with the angle defined between first arm 86*b* and second arm 88*b*), causing the distance between the head ends of first arms 86 and *b* and the foot ends of second arms 88*a* and *b* to decrease, thereby urging seat section 58 and foot section 60 to pivot with respect to each other (more specifically, the foot end of seat section 58 and the head end of foot section 60 pivot upwardly).

When actuator 82 changes the orientation of deck sections 56, 58, and 60 from the horizontal flat orientation, sleeve 72 and beam 70 will slide with respect to each other. This sliding will either increase or decrease the overall length of head end rail 62. However, the overall distance A (FIG. 4) between the posts 96 at head end 42 and the posts 96 at foot end 46 remains the same as it was when deck sections 56, 58, and 60 were in the flat horizontal orientation (FIG. 2). The extension and retraction of beam 70 and sleeve 72 thereby allows patient support deck 36 to be completely supported by elevation assemblies 34*a-d* that are positioned at fixed locations on base 32, even when support deck 36 pivots to orientations other than horizontally flat.

When deck sections 56 and 58 pivot with respect to each other via the action of actuator 82, a distance B (FIG. 4) between head section 56 and seat section 58 also changes. More specifically, as the pivotal junction between seat section 58 and foot section 60 moves upwardly from the horizontal orientation (FIG. 2) to a raised orientation (such as FIG. 4), distance B increases. Further, as the pivotal junction between seat section 58 and foot section 60 moves downwardly to the horizontal orientation, distance B decreases. The changing length of distance B operates as a shear reduction mechanism that reduces the shear forces that would otherwise be created between the sleep surface 38 and the patient as the support deck 36 pivots. The pivoting of head section 56 between the horizontal orientation illustrated in FIG. 2 to a raised orientation, such as that shown in FIG. 4, is carried out by way of a separate actuator (not shown) that is suitably coupled between head section 56 and head end support rails 62 (or structures attached thereto). This actuator can be activated independently of actuator 82, or simultaneously therewith.

Figure 5:
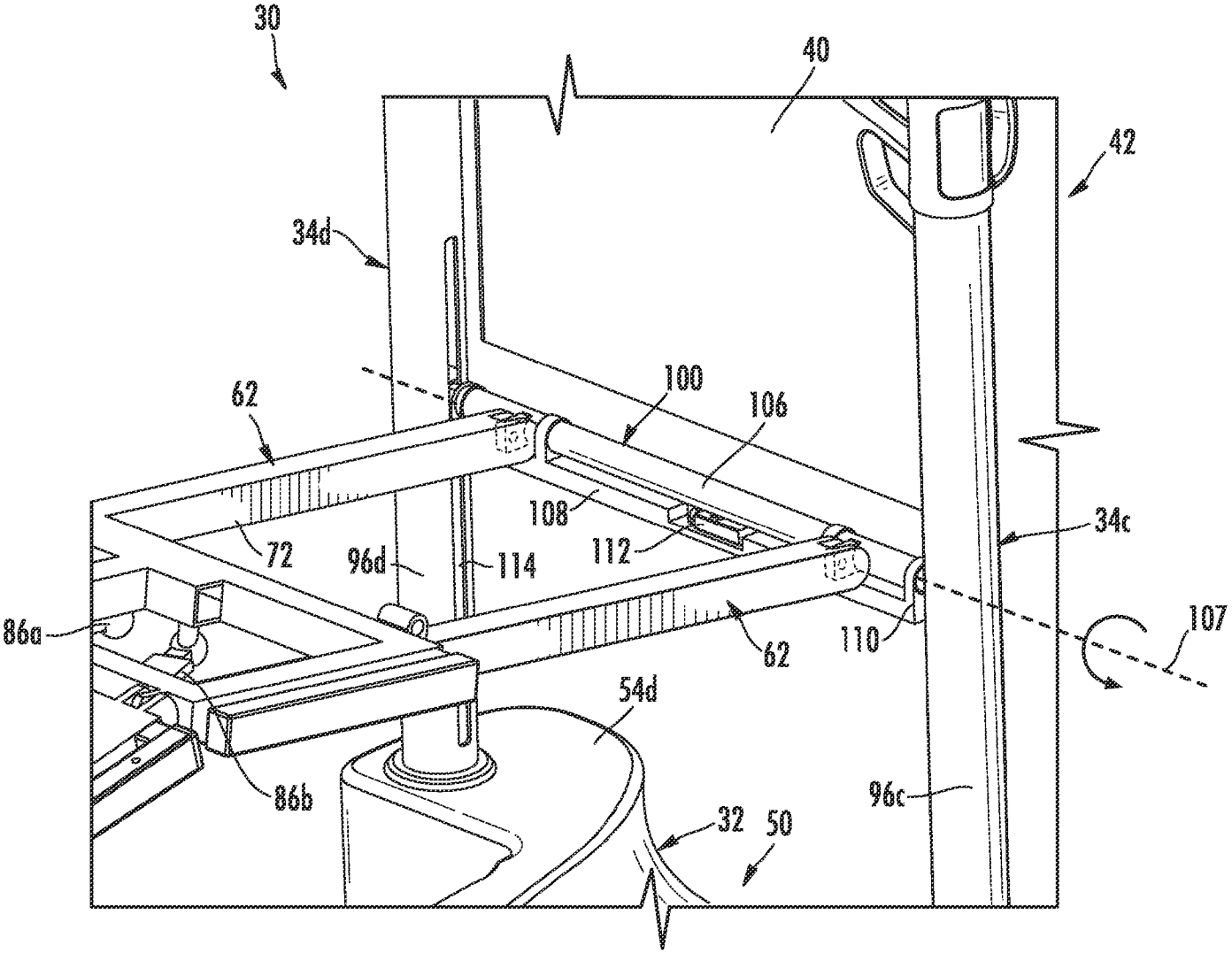
FIG. 5 is a perspective view of a horizontal foot beam and its connection to a pair of foot end elevation assemblies.
Figure 6:
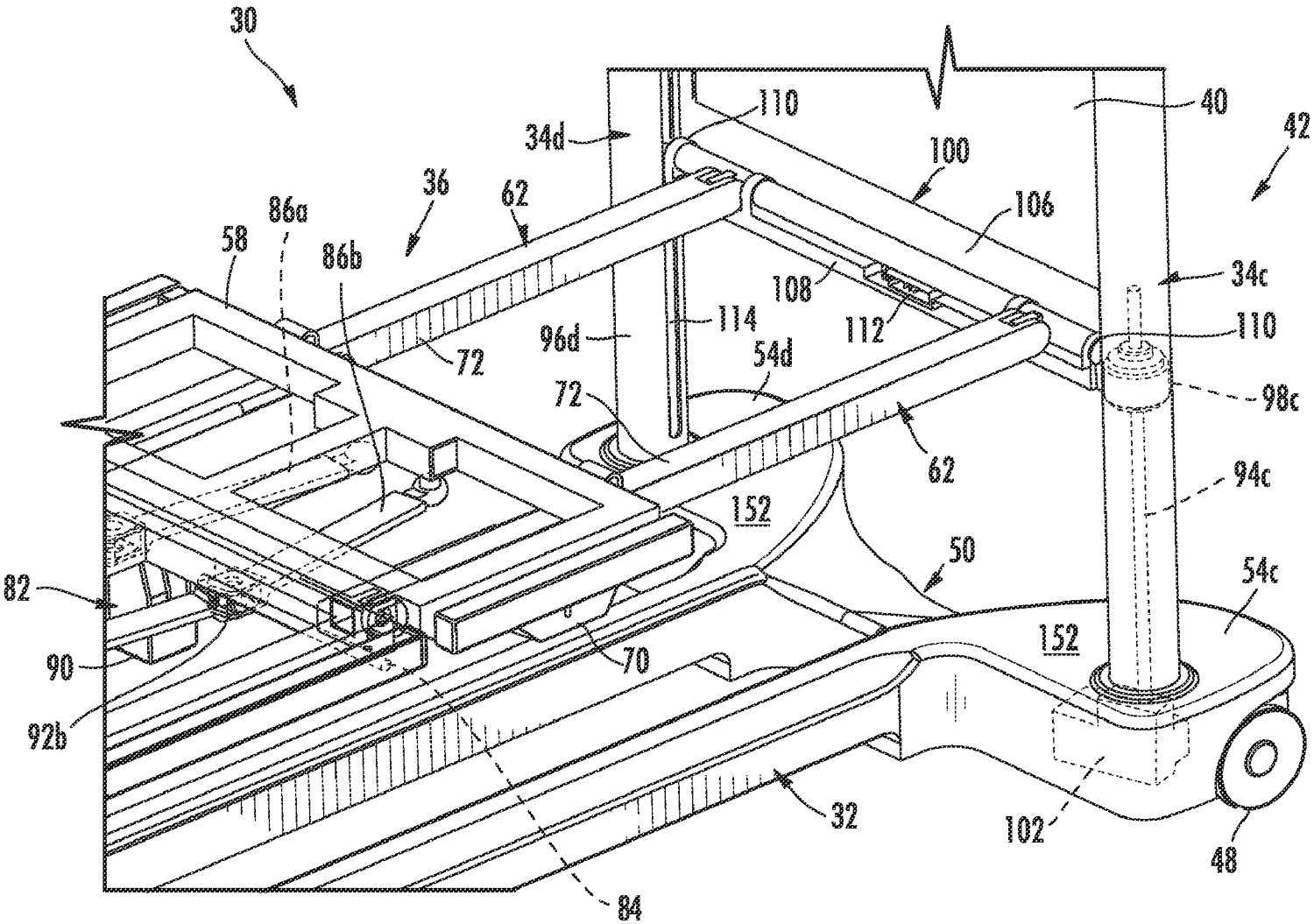
FIG. 6 is a perspective view of a motor, a vertical shaft, and a collar of one of the elevation assemblies.

FIGS. 5 and 6 illustrate in greater detail the construction of two of the elevation assemblies 34*c* & *d*. As illustrated in FIG. 6, elevation assembly 34*c* includes a vertical threaded shaft 94*c* housed with a cylindrical post 96 that extends vertically upward from corner 54*c* of base 32. Vertical threaded shaft 94*c* has threads on its exterior surface that mate with interior threads on a collar 98*c*. Collar 98*c* is pivotably joined to one end of a head end horizontal beam 100. The other end of head end horizontal beam 100 is joined to collar 98*d*, which is threadingly mounted onto a vertical shaft 94*d* (not shown) inside elevation assembly 34*d*. Housed within base 32 at each of corners 54*a-d* is a motor 102. Each motor 102 is coupled with one of the threaded shafts 94*a-d* in each of the elevation assemblies 34*a-d*. Operation of motors 102 causes their respective vertical threaded shafts 94*a-d* to rotate. This rotation, in turn, causes collars 98*a-d* to move upward or downward, depending upon the direction of rotation of threaded vertical shafts 94*a-d*. When collars 98*c-d* move upward or downward, they likewise cause head end horizontal beam 100 to move upward or downward. Similarly, when collars 98*a-b* move upward or downward, they likewise cause a foot end horizontal beam 104 to move upward or downward (FIG. 1).

The upward or downward movement of head end horizontal beam 100 causes an upward or downward movement of the head end of patient support deck 36 (i.e. the end of support deck 36 adjacent head end 42 of patient support apparatus 30). The upward or downward movement of foot end horizontal beam 104 causes an upward or downward movement of the foot end of patient support deck 36. Because head end rails 62 are each pivotably coupled by any suitable means (such as, but not limited to, a ball joint) to head end horizontal beam 100, and because foot end rails 64 are also each pivotably coupled by any suitable means (such as, but not limited to, a ball joint) to foot end horizontal beam 104, it is possible to raise head end horizontal beam 100 and foot end horizontal beam 104 to different heights. This causes patient support deck 36 to tilt in a longitudinal direction. By independently controlling the height of head end horizontal beam 100 and foot end horizontal beam 104, patient support deck 36 can be tilted to the Trendelenberg and reverse Trendelenberg positions, as well as other positions.

A controller (not shown) may be provided at any suitable location on patient support apparatus 30 that controls the speed of operation of each of the motors 102. The controller may include a conventional microprocessor or microcontroller, or any other suitable electronic control circuitry for controlling the speed of the motors 102 in the elevation assemblies 34*a-d*. The controller may desirably be part of a closed loop control circuit, although open loop control circuits may also be used. In one embodiment, the controller may be a proportional-integral-derivative (PID) controller. The controller is configured to operate the four motors 102*a-d* in several different manners. In a first manner, the controller operates each of the four motors 102*a-d* at the same speed, causing support deck 36 to rise or fall uniformly. In a second manner, the controller operates the motors of elevation assemblies 34*a* & *b* at the same speed, causing the foot end of support deck 36 to rise or fall. In a third manner, the controller operates the motors of elevation assemblies 34*c* & *d* at the same speed, causing the head end of support deck 36 to rise or fall. In a fourth manner, the controller operates the motors of elevation assemblies 34*a* and 34*c* at the same speed, causing patient support deck 36 to tilt about its longitudinal axis (which is made possible by the ball joints, or similar joints, between the collars 98 and either bottom bar 108 or bottom bar 118 at the head end and foot ends 42 and 46, respectively, of patient support apparatus 30. In a fifth manner, the controller operates the motors of elevation assemblies 34*b* & *d* at the same speed, which also causes the patient support deck 36 to tilt about its longitudinal axis. The various manners of operating the motors can be combined in any manner, and it will be understood that the controller may operate the motors in still different manners. Further, the controller need not offer all these different manners of controlling the motors 102.

As can be seen more clearly in FIG. 5, head end horizontal beam 100 includes a top shaft 106 and a bottom bar 108. Head end rails 62 are pivotably coupled directly to top shaft 106. A flange 110 is provided at each end of bottom bar 108 that includes a housing (not shown) in which a rotational axis 107 of top shaft 106 is inserted. This housing allows top shaft 106 to rotate about rotational axis 107. A conventional load cell 112 may be positioned in between top shaft 106 and bottom bar 108. Because of the rotational freedom of top shaft 106 with respect to bottom bar 108, any weight placed upon patient support deck 36 will cause top shaft 106 to rotate in the direction indicated by arrow 109 (FIG. 5) which will, in turn, induce a reaction force onto load cell 112. Load cell 112 measures this force and converts it into a weight measurement which may then be passed onto the controller on patient support apparatus 30, or it may be sent to any other suitable location, such as, but not limited to, a site remote from the patient support apparatus 30, such as a hospital network or a nurses station, or other location.

Each flange 110 of bottom bar 108 is coupled to one of collars 98*c* & *d*. As was mentioned previously, this coupling may be by any suitable means, such as, but not limited to, ball joints. Other types of joints may also be used. Whatever the selected coupling, space is provided for the coupling by way of a vertical slot 114 (FIG. 6) defined along the interior of each of posts 96. Vertical slots 114 provide clearance for the coupling between collars 98 and flanges 110 of bottom bar 108 as head end horizontal beam 100 is raised and lowered.

The manner in which foot end horizontal beam 104 is coupled to collars 98*a* & *b* is identical to the manner described above with respect to head end horizontal beam 100 and collars 98*c* & *d*. Further, foot end horizontal beam 104 is constructed in a similar manner to that of head end horizontal beam 100. More specifically, foot end horizontal beam 104 includes a top shaft 116, a bottom bar 118, and a load cell 112 sandwiched between top shaft 116 and bottom bar 118 (FIG. 1). The load cell 112 of foot end horizontal beam 104 measures the weight on patient support deck 36 that is exerted on the foot end of patient support deck 36. Between the two load cells 112 of head end and foot end horizontal beams 100 and 104, it is possible to determine the weight of a patient on patient support deck 36. The outputs of both load cells 112 may be transmitted to the controller on the bed, or may be sent off the bed to any other suitable location. Because of the design of patient support apparatus 30, it is only necessary to utilize two load cells 112 to determine the weight of the patient. In contrast, many beds and stretchers of the prior art have utilized three or more load cells to determine a patient's weight. The design of patient support apparatus 30 thus reduces the cost and complexity of the patient weight determination feature.

Figure 7:
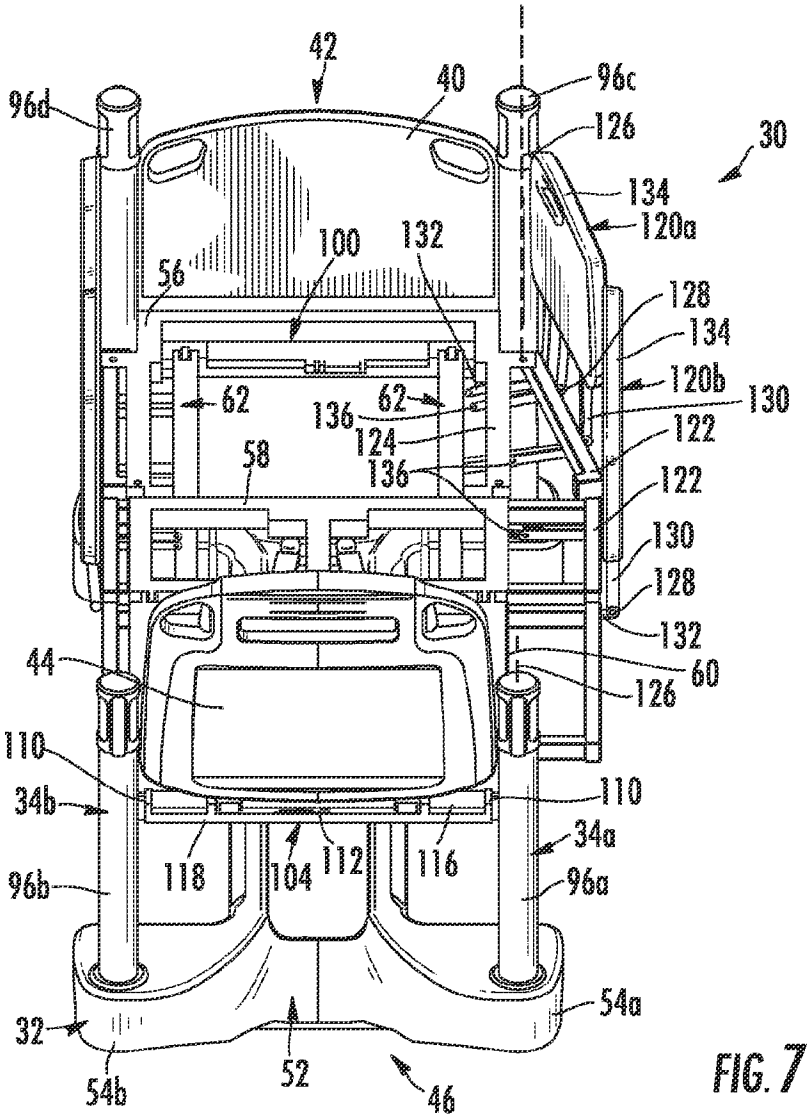
FIG. 7 is a perspective view of the patient support apparatus of FIG. 1 illustrating a pivoting feature and an extendable feature of the side rails.

A variety of different types and styles of side rails can be attached to patient support apparatus 30. Several examples of the different types and configurations of the side rails can be seen in FIGS. 1, 7, 9-14, and 28-29. FIG. 7 illustrates one possible manner of attaching one or more generally planar side rails 120 to patient support apparatus 30. In the manner illustrated in FIG. 7, each side rail 120 includes a horizontal pivot beam 122. The horizontal pivot beam 122 of a head end side rail 120*a* is pivotably coupled to a side beam 124 of head section 56. Horizontal pivot beam 122 is thus free to pivot about a vertical pivot axis 126 between two orientations. In a first orientation, the general vertical plane defined by head end side rail 120*a* is oriented parallel to the longitudinal extent of patient support apparatus 30. In a second orientation, the general vertical plane defined by head end side rail 120*a* is oriented perpendicular to the longitudinal extent of patient support apparatus 30. The first orientation represents the "in-use" position in which the side rail 120 abuts against the side of the patient support deck 36. The second orientation represents the "out-of-the-way" position in which the side rail 120 has been pivoted away from the support deck 36 in order to allow access to patient support deck 36, such as for transferring the patient to or from patient support apparatus 30, or for other means.

Foot end side rail 120*b* (FIG. 7) operates in a similar manner to that described above with respect to head end side rail 120*a*. That is, foot end side rail 120*b* includes a horizontal pivot beam 122 that is pivotably attached to one of foot end rails 64. The horizontal pivot beam 122 of foot end side rail 120*b* pivots about another vertical pivot axis 126 located generally near the foot end 46 of patient support apparatus 30. Foot end side rail 120*b* is likewise pivotable between two orientations: one in which it abuts against the edge of support deck 36, and another in which it is swung outwardly from patient support deck 36 to allow greater access to support deck 36. In tandem, head end side rail 120*a* and foot end side rail 120*b* can be swung open in a manner similar to the saloon doors commonly seen in Western movies. This type of swinging movement allows the side rails 120*a* and *b* to be moved completely out of the way, thereby providing greater access to patient support deck 36. While not illustrated in FIG. 7, additional side rails 120 may also be provided on the opposite side of support deck 36. These additional side rails 120 may be constructed in the same manner as head and foot end side rails 120*a* & *b*. Alternatively, the side rails on the opposite side may be constructed to pivot and/or move in different manners.

In addition to the pivoting about pivot axis 126, side rails 120*a* & *b* may further be pivotable about a horizontal pivot axis defined by pins 128 (FIG. 7). Pins 128 are defined at the intersection of a vertical member 130 and a horizontal member 132 of side rails 120. Pins 128 enable side rails 120 to pivot between the upright orientation depicted in FIG. 7 and a lowered orientation (not shown) in which an edge 134 has moved from being positioned on the top of side rail 120 to being positioned on the bottom of side rail 120. In other words, side rails 120 swing about the pivot axis of pins 128 such that the planar body of side rails 120 moves to an elevation generally lower than that of sleep surface 38, yet still in the same plane as that illustrated in FIG. 7.

Side rails 120 may further be horizontally adjustable. Specifically, horizontal members 132 may be slideably attached to the underside of horizontal pivot beams 122 such that vertical members 130 can be moved further away from, or closer to, horizontal pivot beams 122. This enables the distance between side rails 120 positioned on opposite sides of support deck 36 to be adjusted. Thus, if extra space is needed on support deck 36 to accommodate a larger patient, or for other reasons, side rails 120 can be slid away from support deck 36 to create this extra space. The manner in which horizontal members 132 may be slidingly coupled to horizontal pivot beam 122 can be varied within the scope of the present invention. Such a coupling may include, but is not limited to, a sleeve-and-beam type of construction the same as, or similar to, any of the various configurations of beam 70 and sleeve 72 (including those constructions of FIGS. 32*a-c*).

Figure 9:
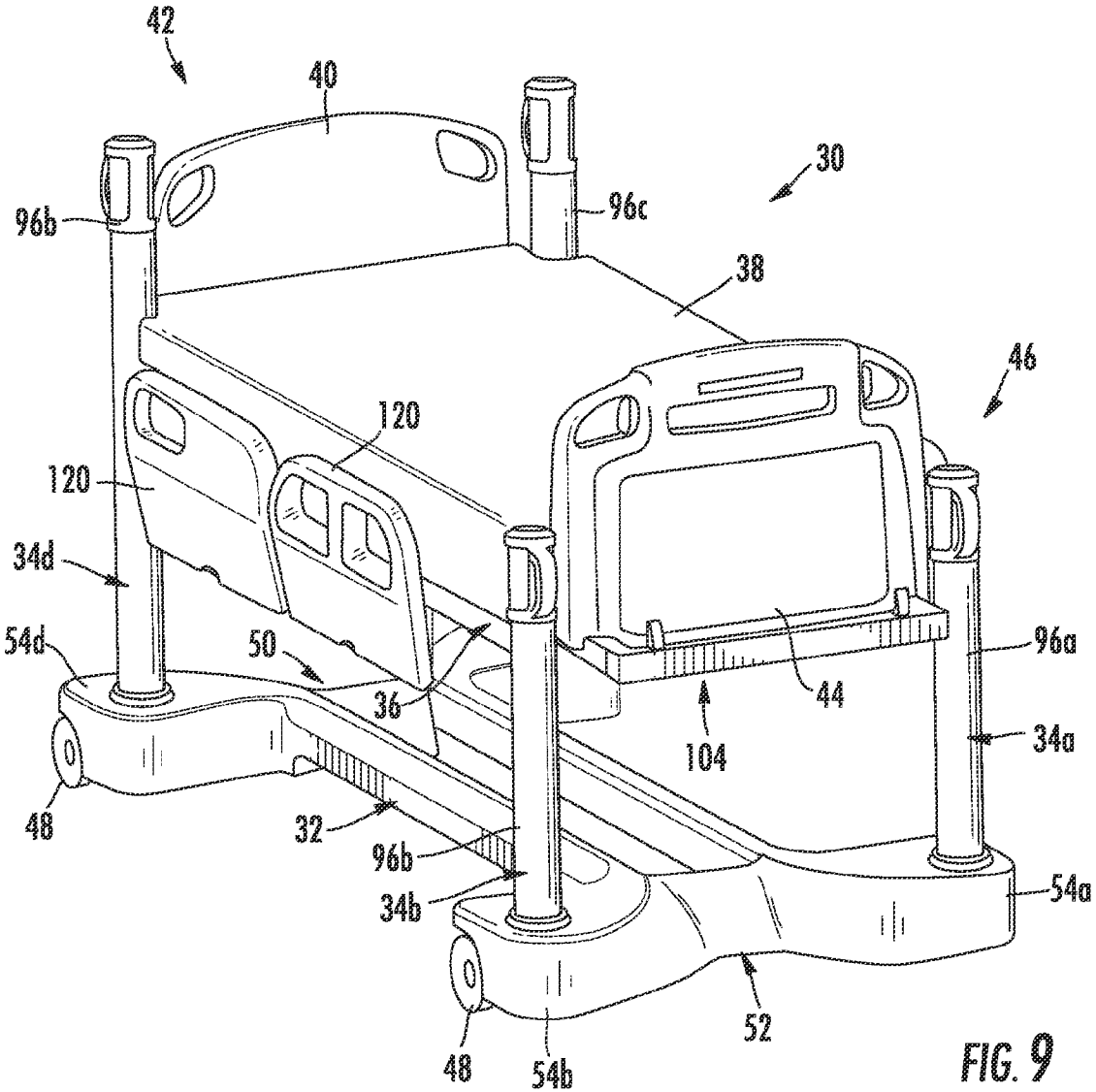
FIG. 9 is a perspective view of the patient support apparatus of FIG. 1 illustrating the side rails moved to a lowered position.

In an alternative arrangement, horizontal members 132 may be pivotably coupled to the underside of patient support deck 36 at their interior ends 136 (FIG. 7). This would enable the side rails 120 to pivot between the orientation depicted in FIG. 7 and that shown in FIG. 9. As can be seen in FIG. 9, side rails 120 have been pivoted to a lowered position suitable for transferring a patient to or from sleep surface 38. Such a pivoting takes place about a horizontal pivot axis (not shown) that extends in the direction of the longitudinal axis of the patient support apparatus 30 (i.e. in the direction from head end 42 to foot end 46, or vice versa).

Figure 11:
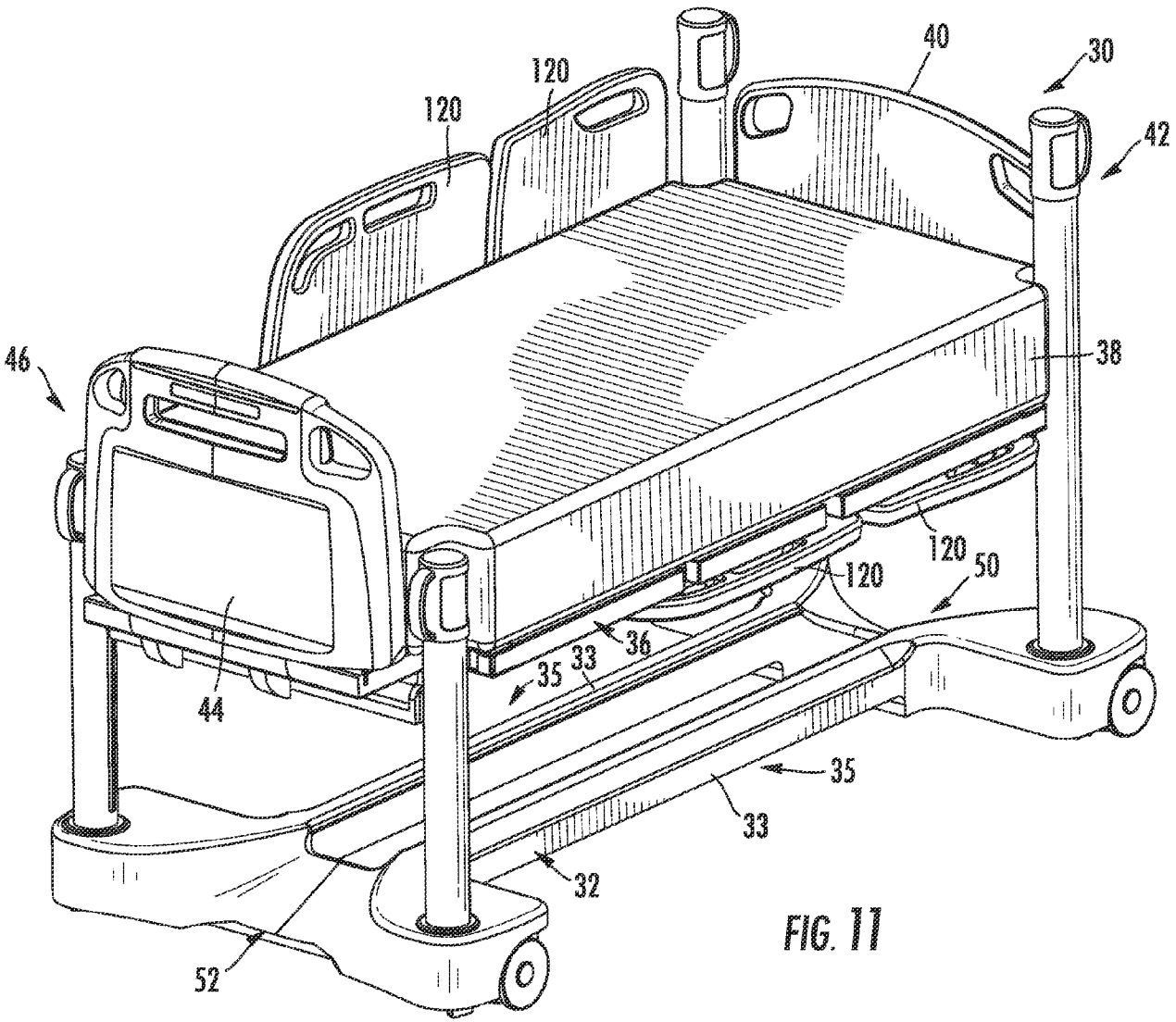
FIG. 11 is a perspective view of the patient support apparatus of FIG. 1 illustrating the side rails moved to an alternative stowed position.

In an alternative method of attachment, side rails 120 can be coupled to support deck 36 such that they are pivotable to a flat, horizontal orientation that then allows the side rail to be slid underneath patient support deck 36. FIG. 11 illustrates an example of this type of attachment to support deck 36. As shown, patient support apparatus 30 includes two side rails 120 that are in the upright position, and two side rails 120 that have been pivoted and slid to the stowed position underneath support deck 36. This stowed position offers the advantages of moving the side rail completely out of the way of the patient, and also consuming very little space between support deck 36 and base 32. This latter advantage ensures that support deck 36 will still be able to be lowered to a very small height above the floor.

When side rails 120 are attached and pivotable in the manner illustrated in FIG. 11, it should be noted that the side rails 120 do not interfere with the lowering of support deck 36. Stated alternatively, when the side rails 120 are in the stowed position and support deck 36 is lowered to its lowest orientation, the stowed side rails 120 will not contact either one of a pair of base beams 33. Base beams 33 are part of base 32 and they extend longitudinally from head end 42 to foot end 46 of patient support apparatus 30. Because base beams 33 are positioned generally along the longitudinal center of patient support apparatus 30, the side rails 120, when in the stowed position, will not contact base beams 33, but will instead fit into one of spaces 35 adjacent base beams 33. Thus, side rails 120 do not create a physical limitation on the degree to which support deck 36 may be lowered.

Figure 28:
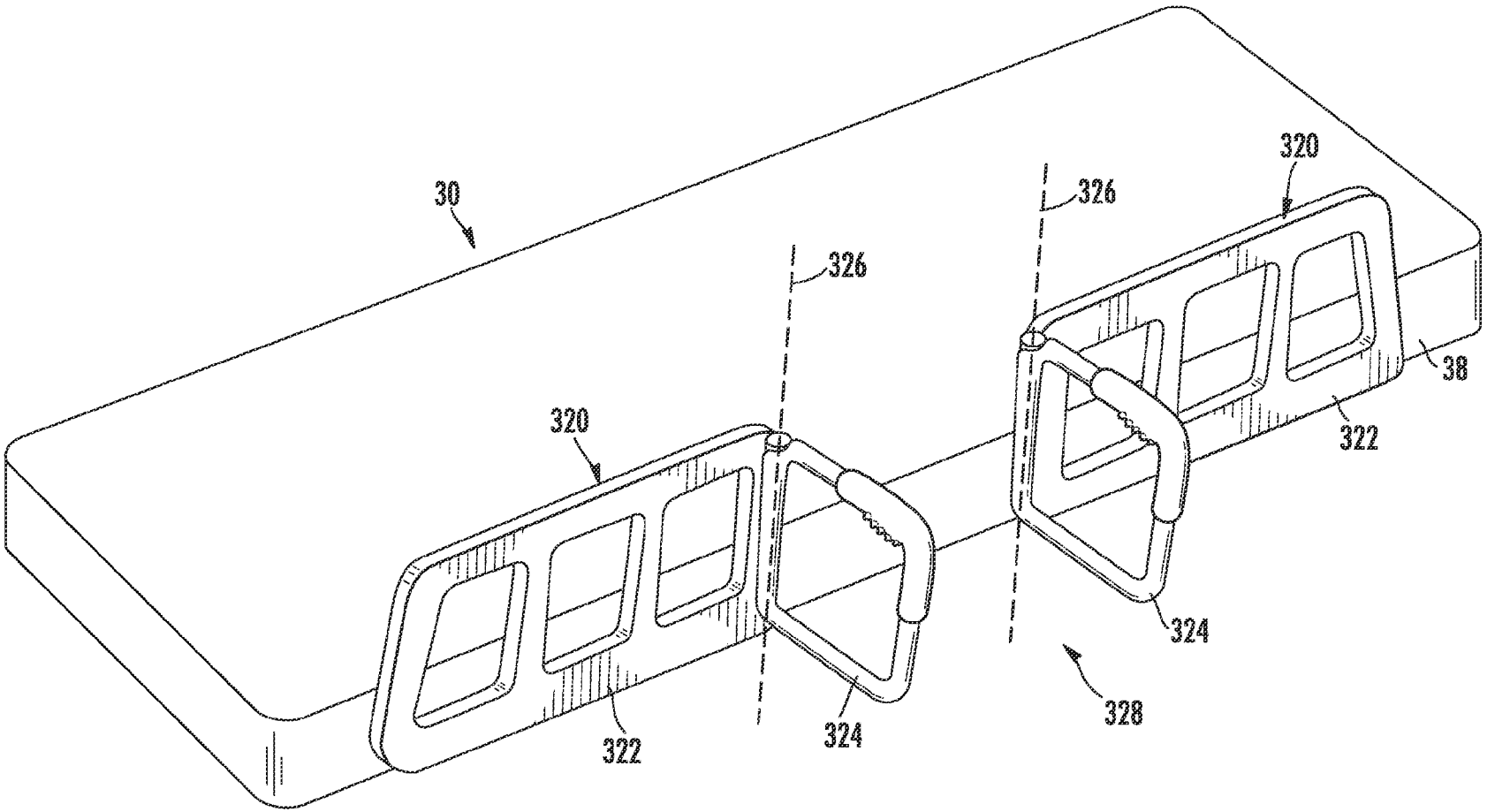
FIG. 28 is a perspective view of a set of side rails that may be used with any of the various patient support apparatus embodiments described herein, as well as other patient support apparatuses.
Figure 29:
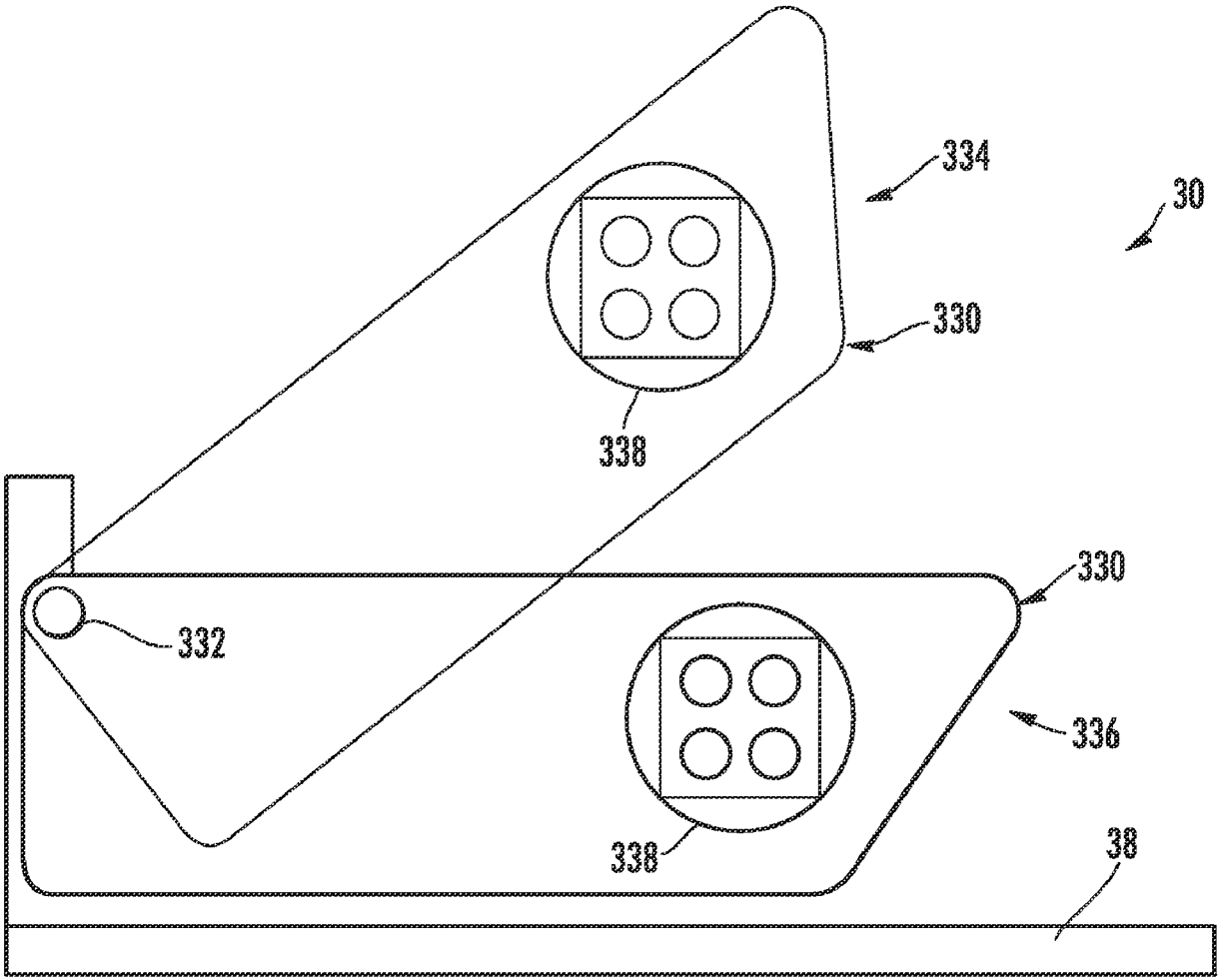
FIG. 29 is a front, elevational view of a side rail that may be used with any of the various patient support apparatus embodiments described herein, as well as other patient support apparatuses.

FIGS. 28 and 29 illustrate alternative embodiments of side rails that may be attached to patient support apparatus 30. In FIG. 28, the side rails 320 are divided into two sections: a stationary section 322 and a pivotable section 324. Pivotable sections 324 are pivotable about vertical pivot axes 326. When attached to support deck 36 in the configuration illustrated in FIG. 28, the pivotable sections 324 of adjacent side rails 320 are next to each other. When pivotable sections 324 are both opened (i.e. pivoted to the orientation shown in FIG. 28), an access space 328 is created between side rails 320 that provides ample room for patient ingress and egress onto patient support apparatus 30. Further, pivotable sections 324 can be used as handles which the patient may grip to help support himself or herself as he or she exits or enters patient support apparatus 30.

In another alternative, a side rail 330 (FIG. 29) may be incorporated into any of the patient support apparatuses described herein. Side rail 330 includes a pivot point 332 that enables the side rail 330 to be pivoted between a raised orientation 334 and a lowered orientation 336. Side rail 330, as well as any of the other side rails discussed herein, may include a control panel 338 with one or more user-activated controls that enable either the patient or attending personnel to control various features of patient support apparatus 30. The features that may be controlled by control panel 338 include the raising and lowering of patient support deck 36, the pivoting of the various sections of patient support deck 36, the reading of load cells 112, communications with health care personnel at remote locations (e.g. remote nurse call), and any other functions that may be desirably performed by patient support apparatus 30.

While not illustrated in the drawings, any of the side rails 120, 320, and 330 may include suitable means for securing the side rails in the different orientations to which they are pivotable. Such means may include detents, latches, or other structures that allow the side rails to be releasably held in any desirable orientation. Further, the sliding of horizontal members 132 along the underside of horizontal pivot beams 122 may include structures for securing horizontal members 132 at selected locations along pivot beams 122. Any conventional structures may be used for this securing. Thus, any of the side rails discussed herein can be locked in any of the various orientations to which they are pivotable or otherwise moveable.

Figure 8:
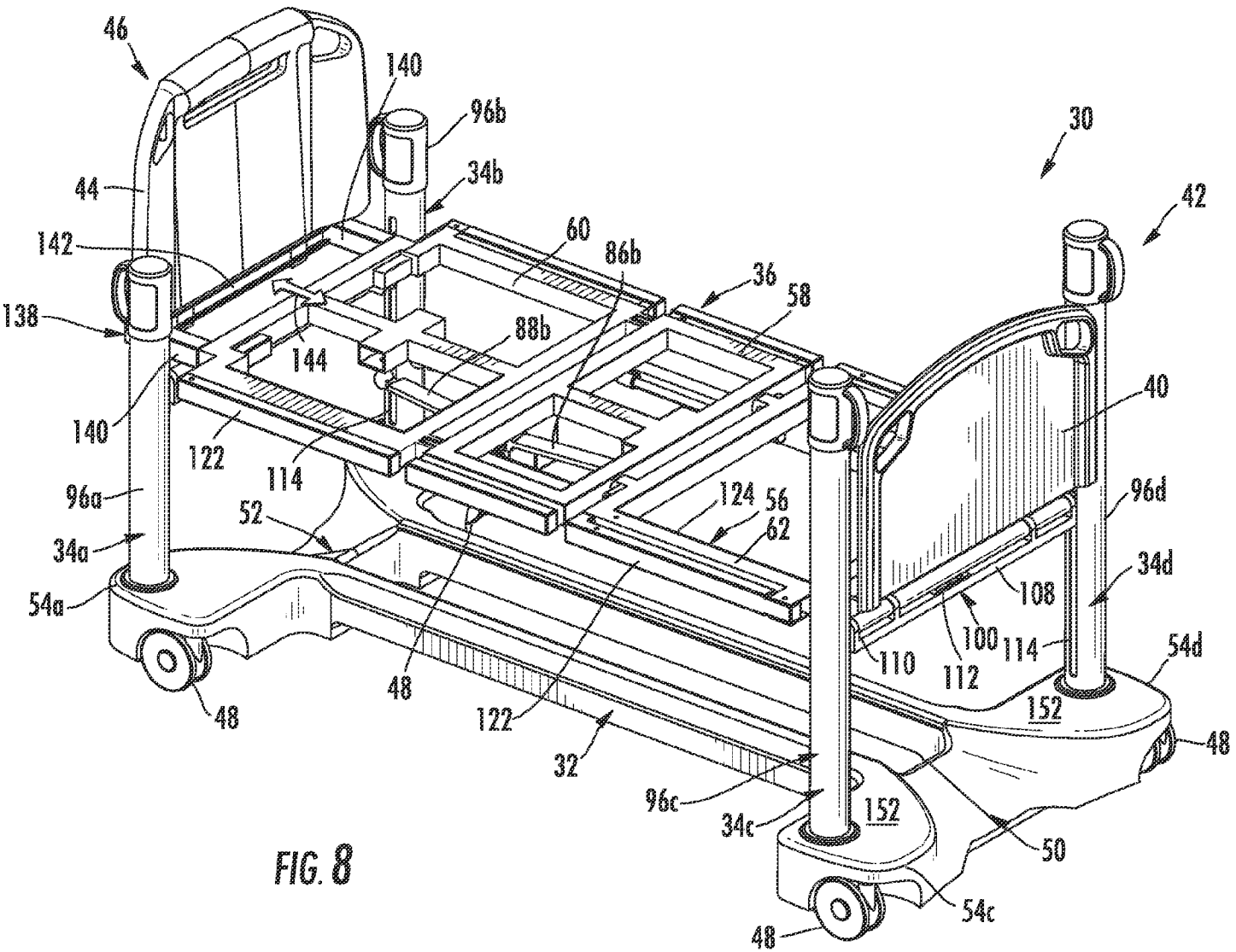
FIG. 8 is a perspective view of the patient support apparatus of FIG. 1 illustrating a support deck extender that increases the length of the support deck.
Figure 10:
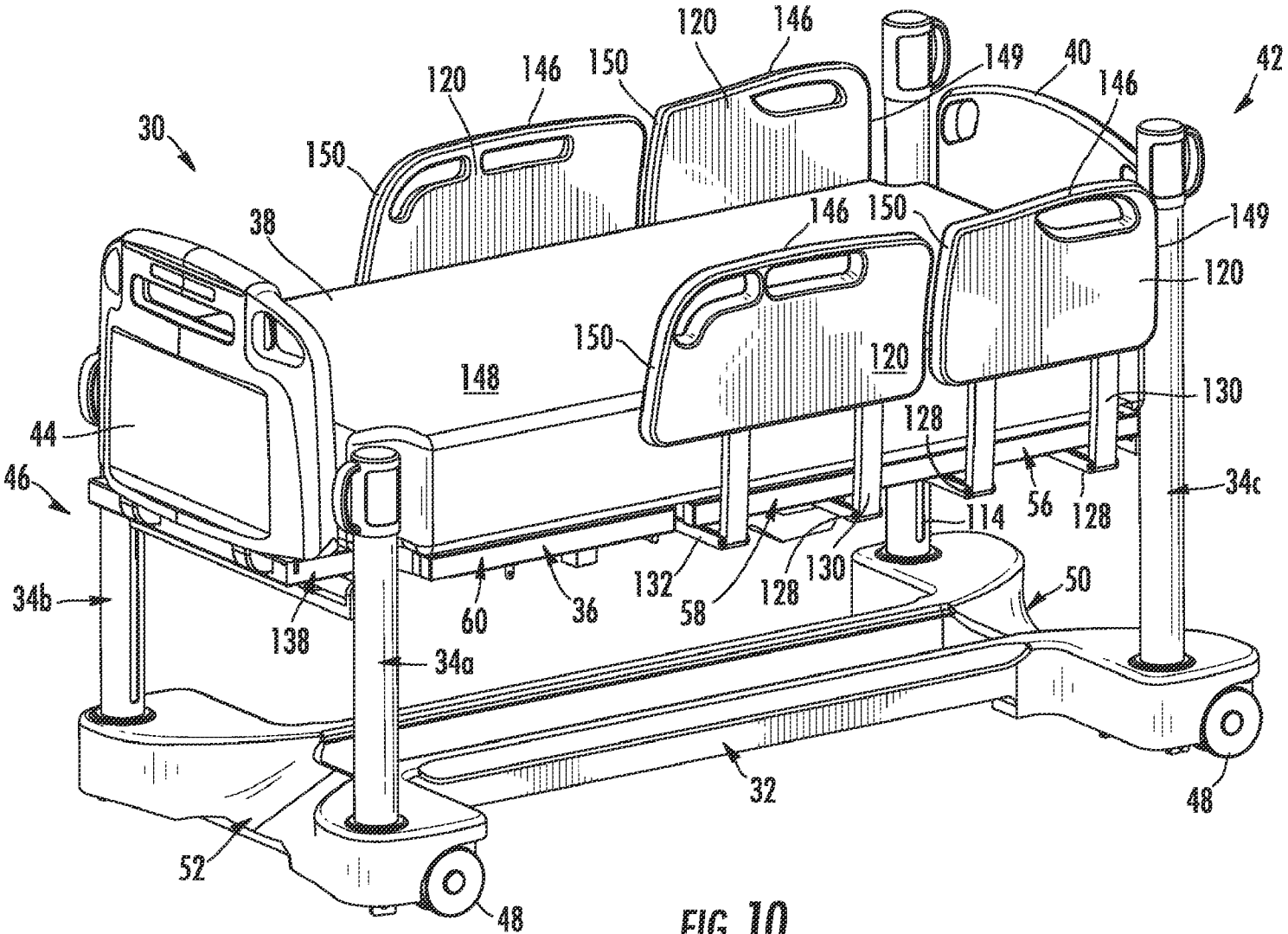
FIG. 10 is a perspective view of the patient support apparatus of FIG. 1 illustrating the side rails moved to a raised position.

FIG. 8 depicts a support deck extender 138 that may be attached to the foot end 46 of patient support deck 36. Support deck extender 138 includes two side beams 140 and an end beam 142 attached to each of the side beams 140 at a right angle. Foot board 44 is attached to end beam 142. Support deck extender 138 is slideably attached to foot section 60 of support deck 36 such that extender 138 can slide in the directions indicated by double arrow 144. That is, extender 138 can slide toward foot section 60 or away from it. When slid away from foot section 60, extender 138 effectively increases the length of patient support deck 36 (FIG. 10 illustrates extender 138 slid partially away from support deck 36). This may be useful for taller patients, or in other situations when a longer patient support deck 36 is desirable. Extender 138 may be slidingly coupled to foot section 60 in any suitable manner. In one manner, extender 138 is slidingly coupled to the underside of foot section 60 in a beam-and-sleeve type arrangement that may take on any of the various configurations discussed above regarding beam 70 and sleeve 72 (including the illustrations of FIGS. 32*a-c*). Extender 138 may be coupled in still other manners to foot section 60.

FIG. 10 illustrates patient support apparatus 30 with two side rails 120 positioned on either side of head section 56 of support deck 36. FIG. 10 also illustrates two side rails 120 positioned on either side of seat section 58 of support deck 36. While FIG. 10 does not illustrate any side rails 120 positioned on the sides of foot section 60 of support deck 36, patient support apparatus 30 may includes side rails attached to foot section 60. Such a situation is depicted in FIGS. 12 and 13, which illustrate three side rails 120 on each side of support deck 36, for a total of six side rails 120. Each of the six side rails 120 could be replaced by any one of side rails 320 and 330, discussed above. Further, each of the six side rails illustrated in FIGS. 12 and 13 could be attached to support deck 36 such that they pivot in any of the manners discussed above with respect to side rails 120 and/or side rails 320 and 330. As shown in FIG. 13, the side rails 120 are pivotable and slideable to a stowed position underneath support deck 36 in which the general plane of the side rail is in a horizontal orientation.

Whatever type of side rails that are used with patient support apparatus 30, they may desirably be height adjustable such that a top edge 146 is positioned at least nine inches above a top face 148 of sleep surface 38. FIG. 10 illustrates this nine inch height above top face 148 of sleep surface 38. Further, the side rails 120 (or 320 or 330) adjacent head end 42 of patient support apparatus 30 are preferably dimensioned such that a front side edge 149 of side rails 120 is no greater than 2.5 inches away from the adjacent post 96. This ensures that the horizontal gap between the front side edge 149 and the post 96 is no greater than 2.5 inches, which helps ensure that a patient's arms or legs do not become wedged between one of the side rails 120 and posts 96. If any side rails 120 (or 320 or 330) are attached to foot section 60 of support deck 36, such side rails may also desirably be dimensioned such that the horizontal gap between their foot side edges 150 and posts 96*a* & *b* is no greater than 2.5 inches.

Base 32 of patient support apparatus 30 may be configured to include one or more recesses in a top surface 152 of each of base corners 54*a-d* (FIG. 1). Such recesses may be dimensioned to support various hospital equipment, such as IV poles, an oxygen canister 154 (FIG. 1), medical devices, or any other structure that may desirably be attached to patient support apparatus 30. Alternatively or additionally, headboard 40 and/or footboard 44 may include coupling structures for supporting oxygen canisters 154 (FIGS. 12 & 13), IV poles, other hospital equipment or medical devices. Base 32 may further include a fifth wheel (not shown) positioned in the center region of base 32 that can move between a lowered position in which it is in contact with the floor and a raised position in which it is out of contact with the floor. Such a fifth wheel can assist in steering patient support apparatus 30 as it is pushed on wheels 48 from location to location. Such a fifth wheel can be especially useful when all of wheels 48 are castered.

Figure 14:
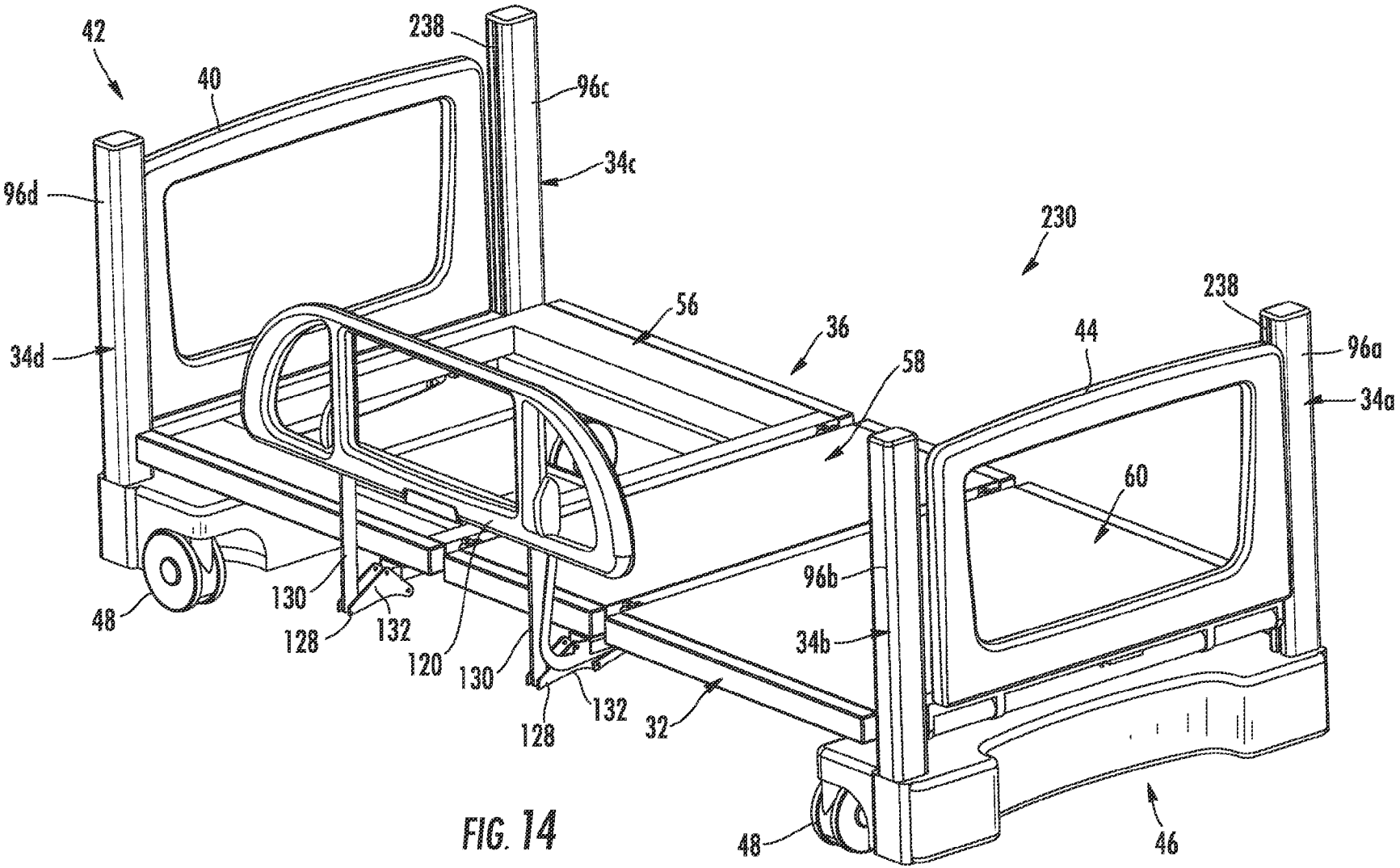
FIG. 14 is a perspective view of a patient support apparatus according to a second embodiment of the present invention.
Figure 15:
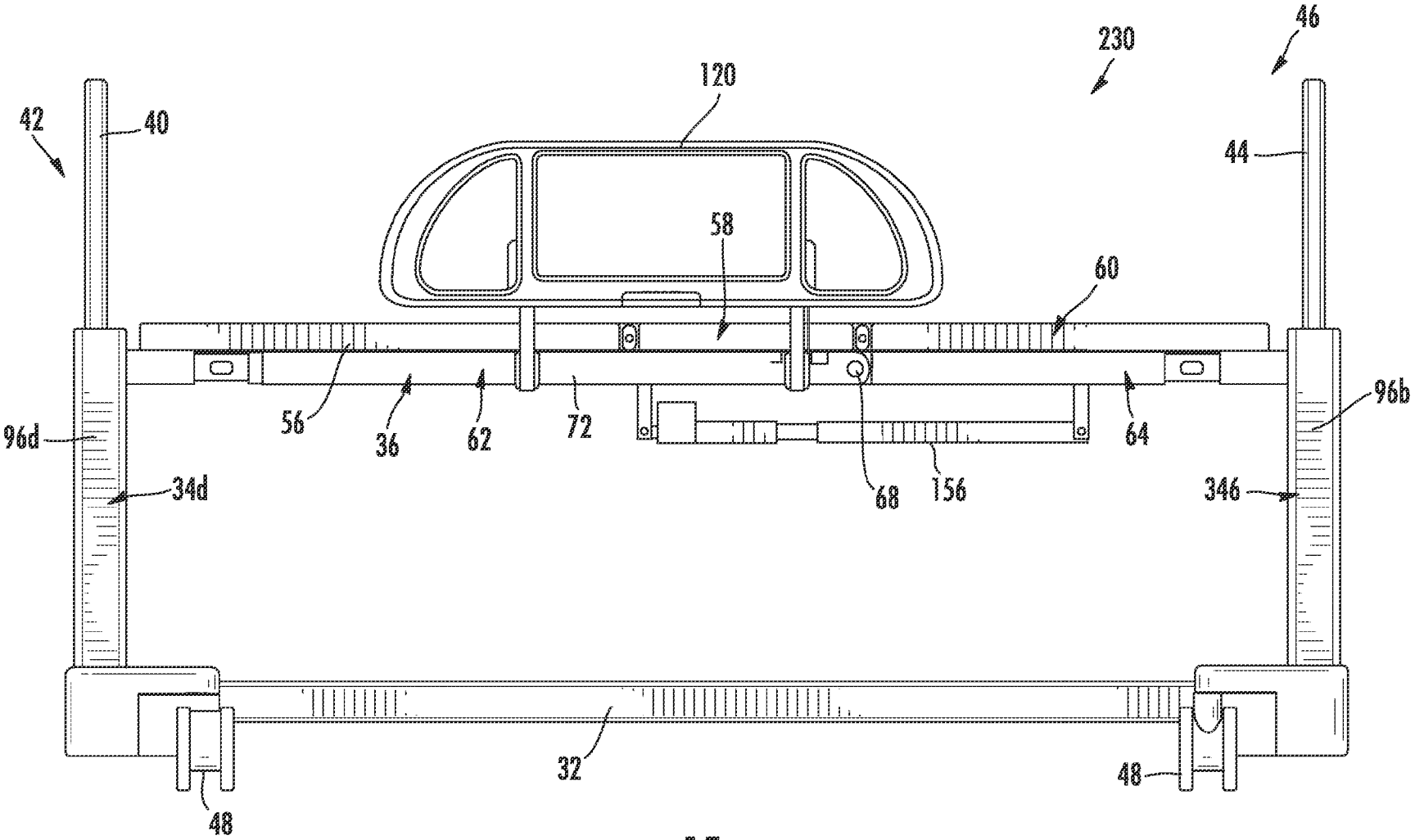
FIG. 15 is a side, elevational view of the patient support apparatus of FIG. 14 illustrating the support deck moved to a raised position.
Figure 16:
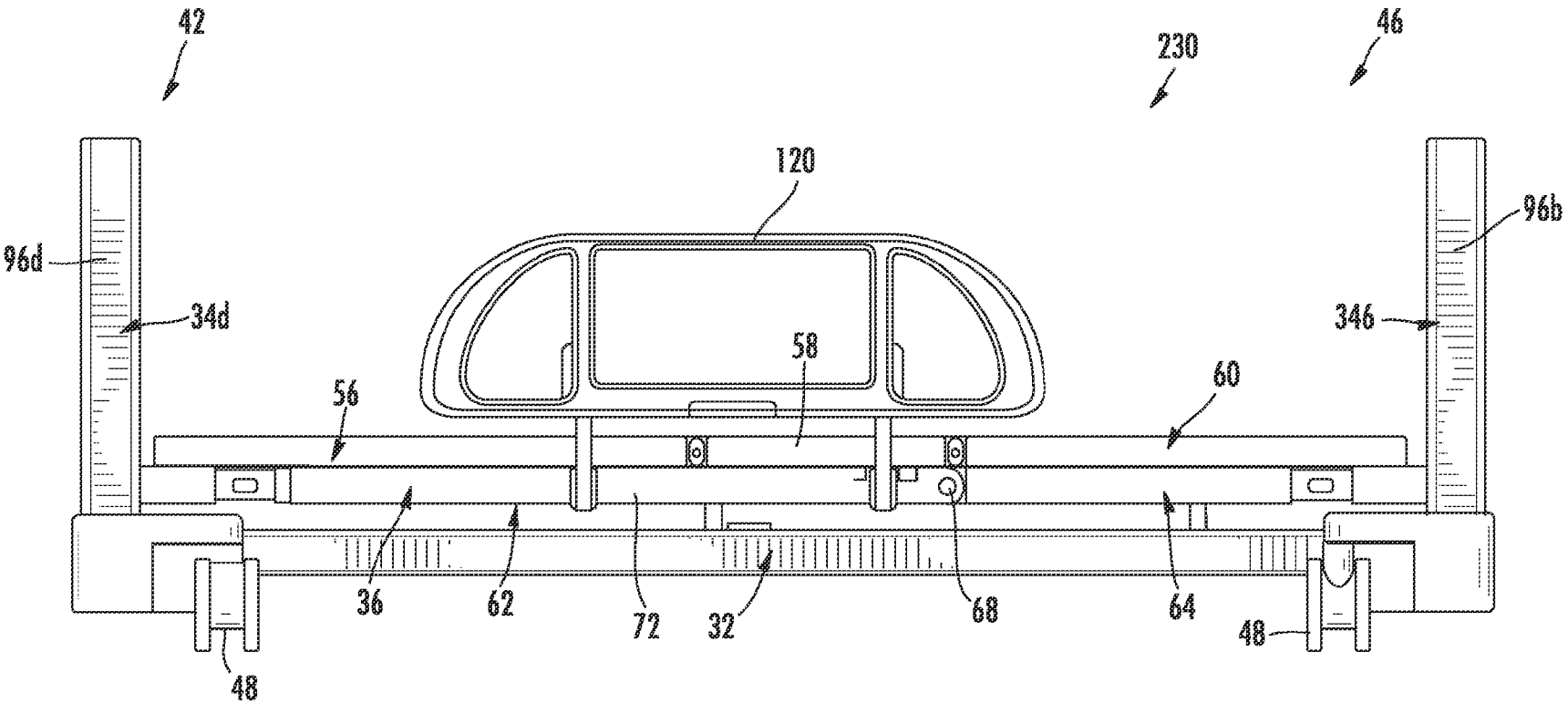
FIG. 16 is a side, elevational view of the patient support apparatus of FIG. 14 illustrating the support deck moved to a lowered position.

FIGS. 14-19 and 24-25 illustrate an alternative embodiment of a patient support apparatus 230. Patient support apparatus 230 shares many features and components in common with patient support apparatus 30. Those components of support apparatus 230 that are the same as those of support apparatus 30 are labeled with the same reference numerals and operate in the same manner as described previously. For example, patient support apparatus 230 includes four posts 96*a-d* which house four elevation assemblies 34*a-d*. Each of these elevation assemblies 34*a-d* works in the same manner as was previously described above with respect to support apparatus 30. That is, they each include a motor 102 (not shown in FIGS. 14-19 and 24-25) that rotates a vertical shaft 94 (also not shown) that, depending upon the direction of rotation, will raise or lower patient support deck 36. FIGS. 14 and 16 illustrate patient support deck 36 in the lowest orientation, while FIG. 15 illustrates patient support deck 36 in its highest orientation. A controller, such as the one described above with respect to support apparatus 30, may be included at any suitable location to control the operation of each of the motors in elevation assemblies 34*a-d* in the same manners described above with respect to support apparatus 30.

Figure 17:
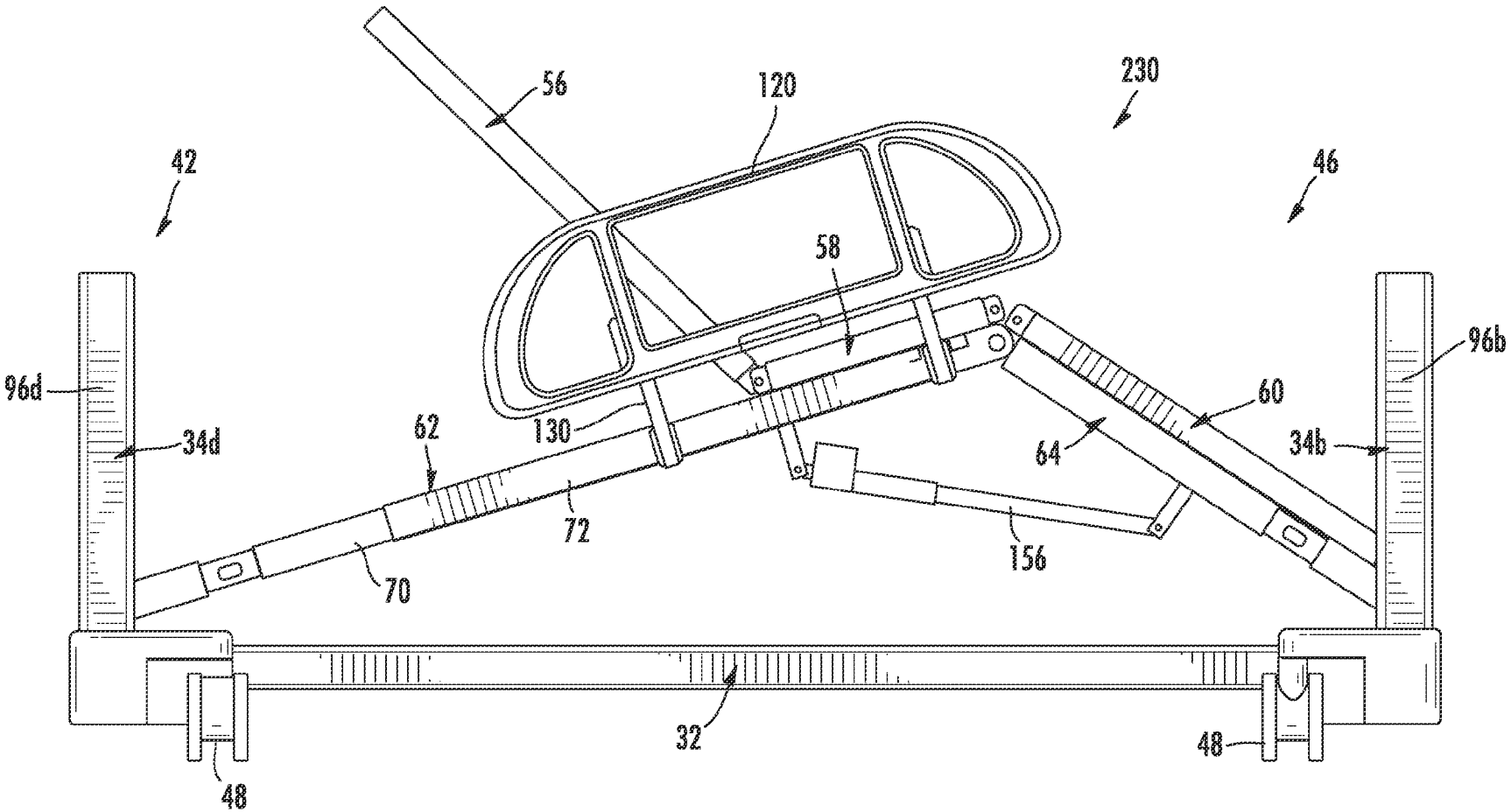
FIG. 17 is a side, elevational view of the patient support apparatus of FIG. 14 illustrating the support deck in a pivoted orientation.

The support deck 36 of patient support apparatus 230 is also pivotable from the flat orientation of FIG. 14 into different orientations, one of which is illustrated in FIG. 17. These pivotable positions are achieved by way of an actuator 156 (FIGS. 15 & 17), which may be constructed in the same manner as actuator 82 described above, or in any alternative manner. As actuator 82 pivots the sections of support deck 36 to different orientations, sleeve 72 and beam 70 of head end rails 62 will retract into and extend out of each other in the manner described above. With the exception of those details of patient support apparatus 230 explicitly mentioned below, all elements of patient support apparatus 230 bearing the same reference numerals as those of patient support apparatus 30 perform the same function and operate in the same manner as described above with respect to support apparatus 30. Accordingly, no further discussion of the common elements will be necessary.

Headboard 40 and footboard 44 may both be slidingly engaged to the two posts 96 nearest them. Operation of elevation assemblies 34 simultaneously raises and lowers headboard 40 and footboard 44, which each slide within vertical tracks 238 (FIG. 14) defined in the interior sides of posts 96.

Figure 18:
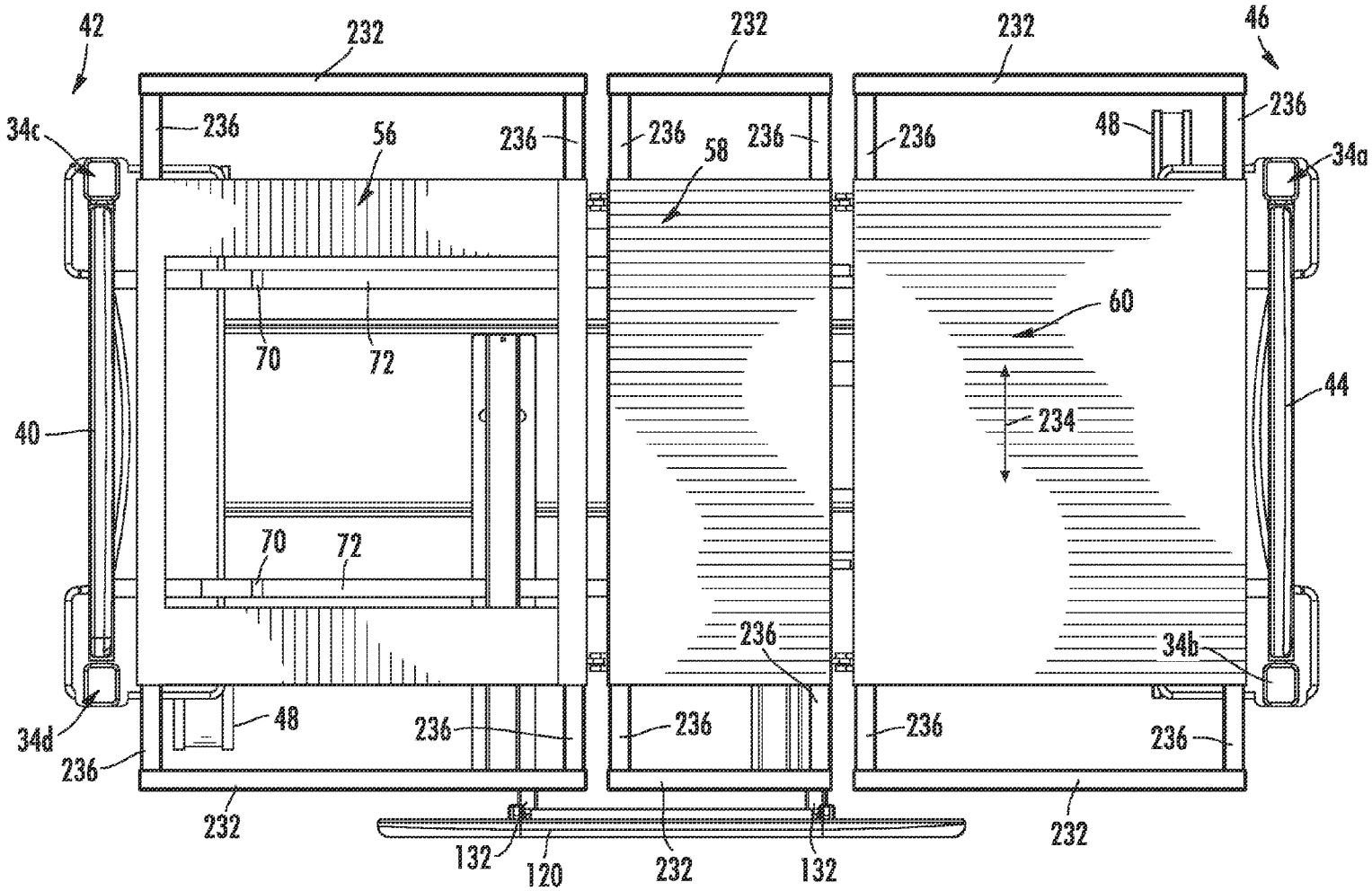
FIG. 18 is a plan view of the patient support apparatus of FIG. 14 illustrating the support deck in an extended width configuration.
Figure 19:
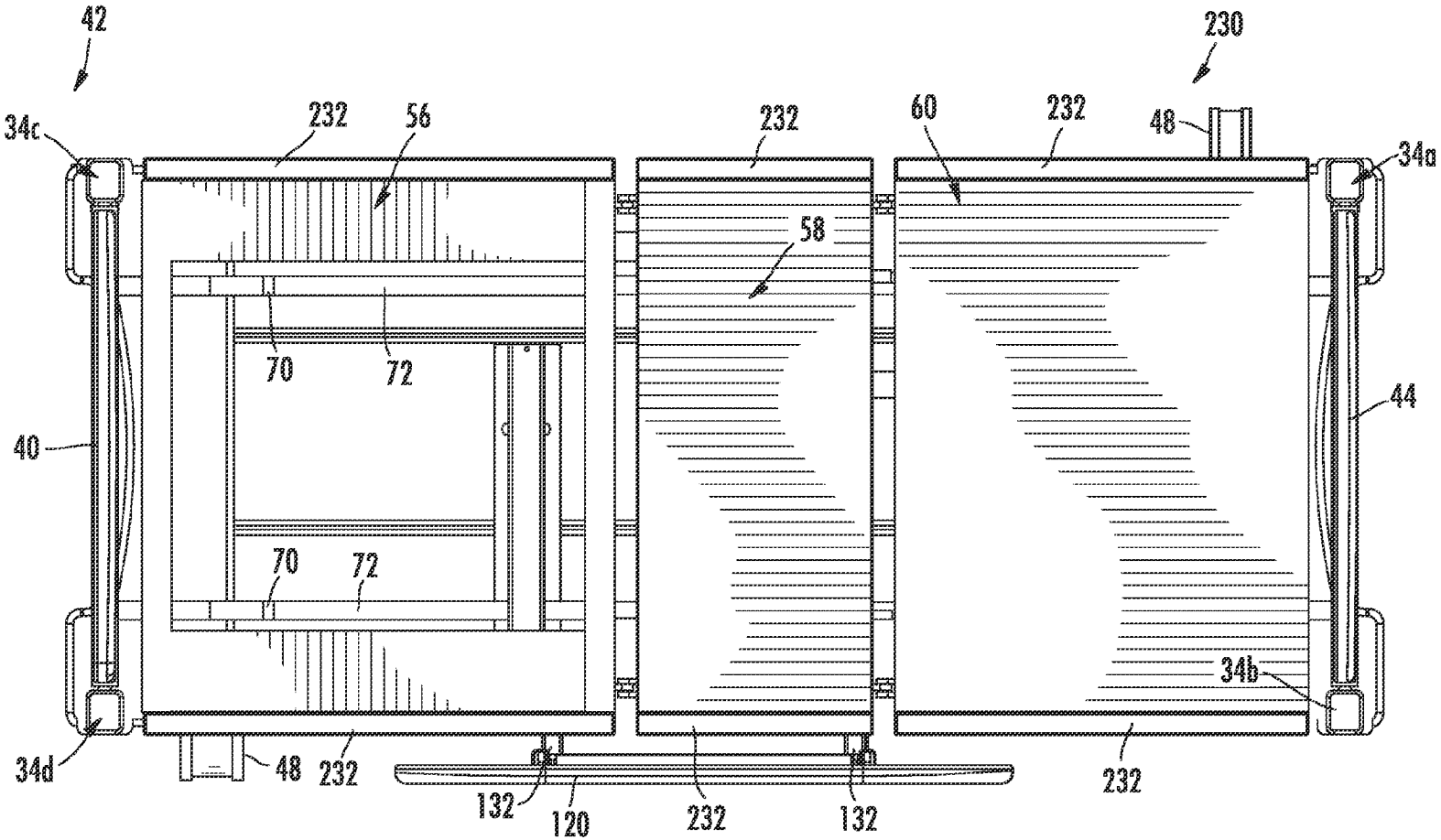
FIG. 19 is a plan view of the patient support apparatus of FIG. 14 illustrating the support deck in an non-extended width configuration.

As can be seen in FIGS. 18 and 19, support deck 36 of patient support apparatus 230 includes a plurality of width extenders 232 that slide toward and away from the center longitudinal line of support apparatus 230 in the directions indicated by double arrow 234. Width extenders 232 allow the width of patient support deck 36 to be adjusted in order to accommodate patients of different sizes, as well as for any other reason it may be desirable to adjust the width of patient support deck 36. FIG. 18 illustrates width extenders 232 in the extended position while FIG. 19 illustrates the width extenders 232 in the retracted position. Width extenders 232 may retract underneath the respective deck section (56, 58, or 60) to which it is coupled, or deck sections 56, 58, and 60 may be constructed to allow extenders 232 to be slid directly into sections 56, 58, and 60 at generally the same elevation as the stationary portions of deck sections 56, 58, and 60. Extenders 232 each include a plurality of cross beams 236 that are received within respective sleeves positioned either within or underneath deck sections 56, 58, and 60. The construction of the sleeves and cross beams 236 may take on any suitable configuration, including such configurations as those discussed above with respect to beam 70 and sleeve 72 (including the variations of FIGS. 32*a-c*).

Figure 21:
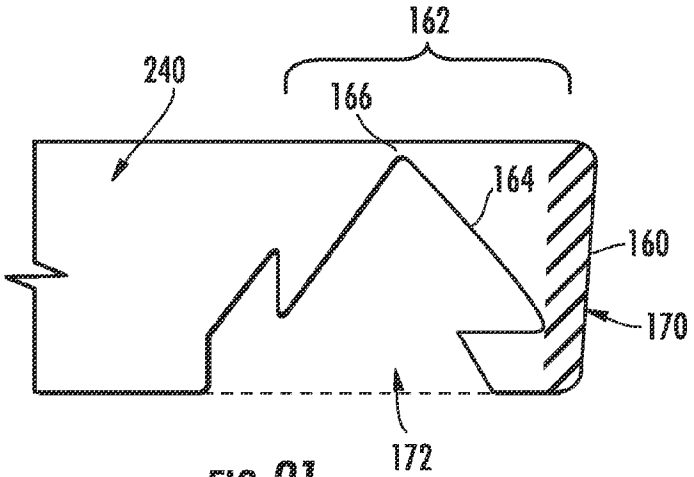
FIG. 21 is a partial, side, elevational view of the extendable sleep surface of FIG. 20 shown in an unfolded configuration.
Figure 20:
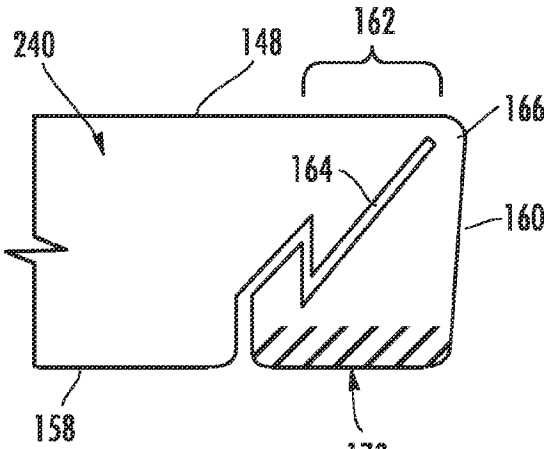
FIG. 20 is a partial, side, elevational view of an extendable sleep surface shown in a folded configuration that may be used on the patient support apparatuses of either FIG. 1 or 14.
Figure 23:
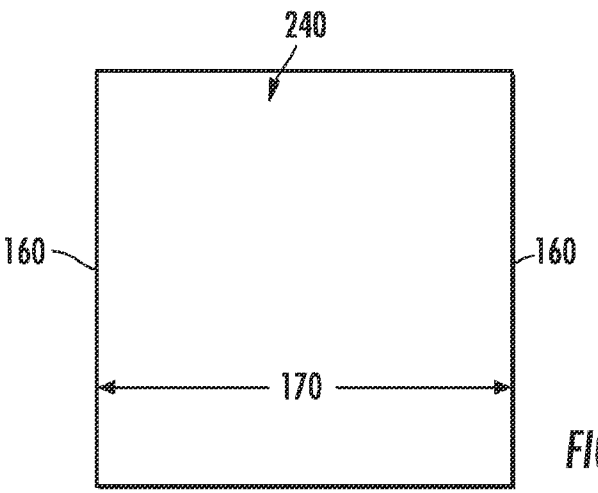
FIG. 23 is a plan view of the sleep surface of FIG. 22 shown in an unfolded configuration.
Figure 22:
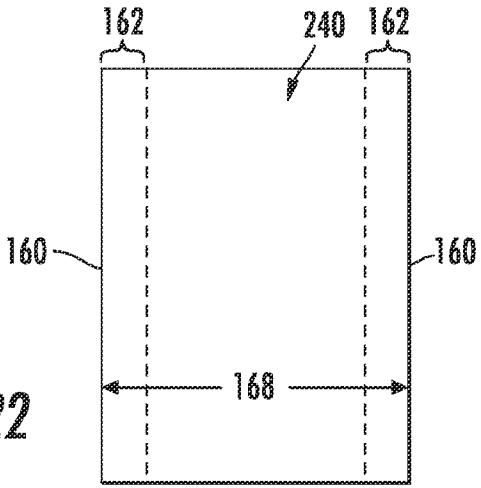
FIG. 22 is a plan view of the sleep surface of FIG. 20 shown in a folded configuration.

FIGS. 20-23 illustrate one embodiment of an extendable sleep surface 38 that can be used with patient support apparatus 230 when extenders 232 are utilized. FIGS. 20-23 illustrate an extendable sleep surface 240 having a top face 148, a bottom face 158, a pair of side edges 160, and a strip region 162 adjacent each side edge 160. Strip region 162 contains a fold line 164 that can fold about a pivot region 166 between a folded orientation (FIG. 20) and an unfolded orientation (FIG. 21). Both sides of sleep surface 38 may include a strip region 162 that is foldable between the folded and unfolded orientations, or only a single side of sleep surface 230 may include a strip region 162 that is foldable. As can be seen in FIG. 22, which is a plan view of sleep surface 240 in the folded orientation, sleep surface 240 has a first width 168. As can be seen in FIG. 23, which is a plan view of sleep surface in the unfolded orientation, sleep surface 240 has a second width 170 when unfolded that is greater than first width 168 when folded. A single sleep surface 240 can thus be used with patient support apparatus 230 and the width of the sleep surface 240 can be adjusted to correspond to the width adjustments made to support deck 36 via width extenders 232.

Strip region 162 may also included a stiff region 170 that is stiffer than the surrounding regions, particularly those regions near top face 148 which are desirably soft so that a patient can lie comfortably on sleep surface 240. Stiff region 170, however, is relatively more rigid than these regions such that when extendable sleep surface 240 is unfolded to the orientation of FIG. 21, stiff region 170 becomes positioned along side edge 160. The relative stiffness of stiff region 170 helps support the outer edges 160 of sleep surface 240 against downward pressures applied to top face 148 over the areas above a gap 172 left behind by the unfolding of fold line 164. Thus, while no material of sleep surface 240 is contained within gap 172, stiff region 162 helps provide a certain amount of flexible resistance to the area of top face 148 above gap 172, thereby ensuring the patient still experiences a certain degree of softness in this region. Extendable sleep surface 240, as with sleep surface 38, may be made out of any suitable materials that provide suitable softness and comfort for a patient positioned on top of support deck 36. In one embodiment, either or both of sleep surfaces 38 and 240 may include one or more air bladders that are selectively inflatable to different levels of pressure, thereby allowing different levels of support to be provided to the patient. If more than one air bladder is provided, the air bladders may be selectively inflatable so that different ones of the air bladders can be inflated to different pressures.

Figure 24:
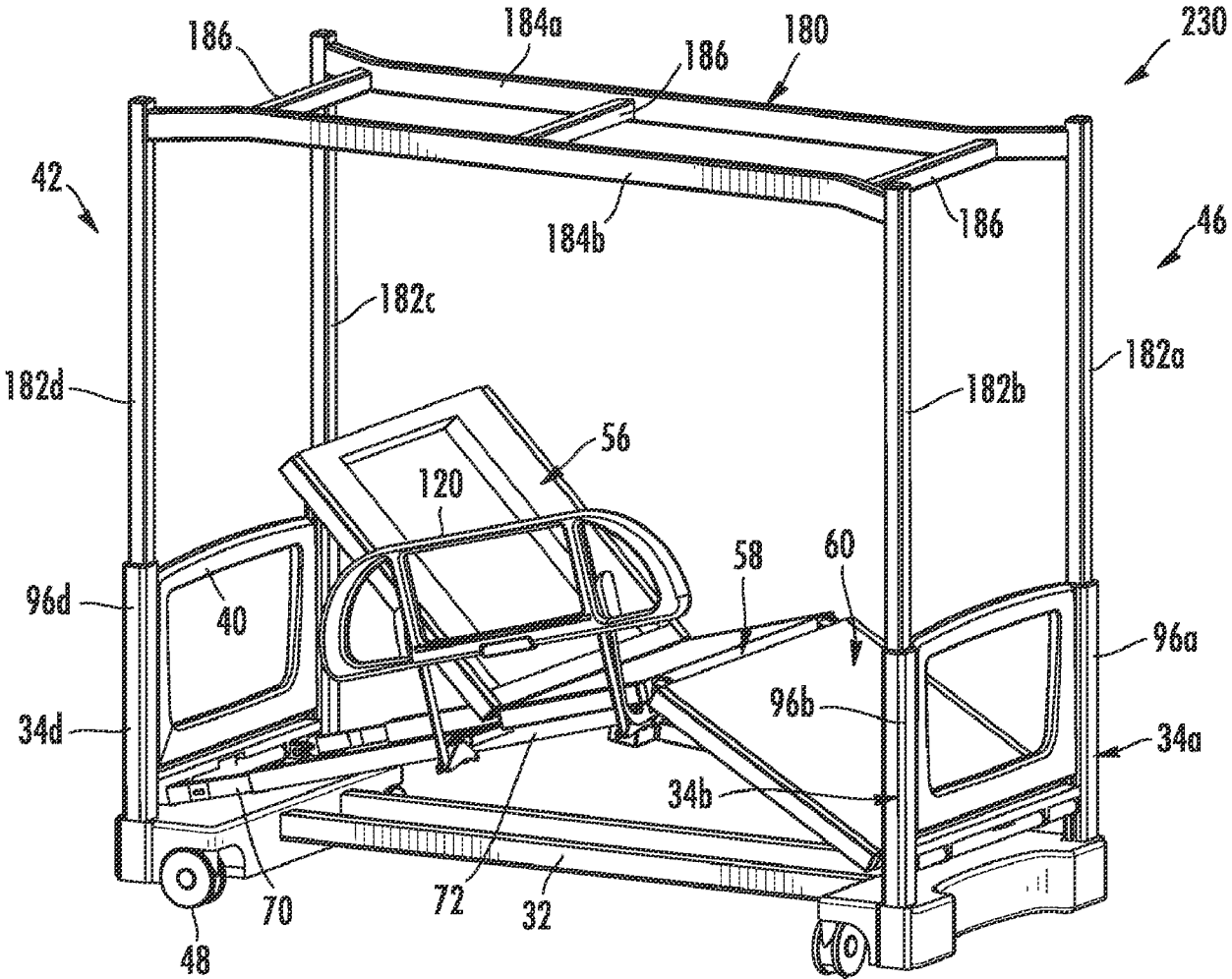
FIG. 24 is a perspective view of the patient support apparatus of FIG. 14 shown with an overhead support structure attached.
Figure 25:
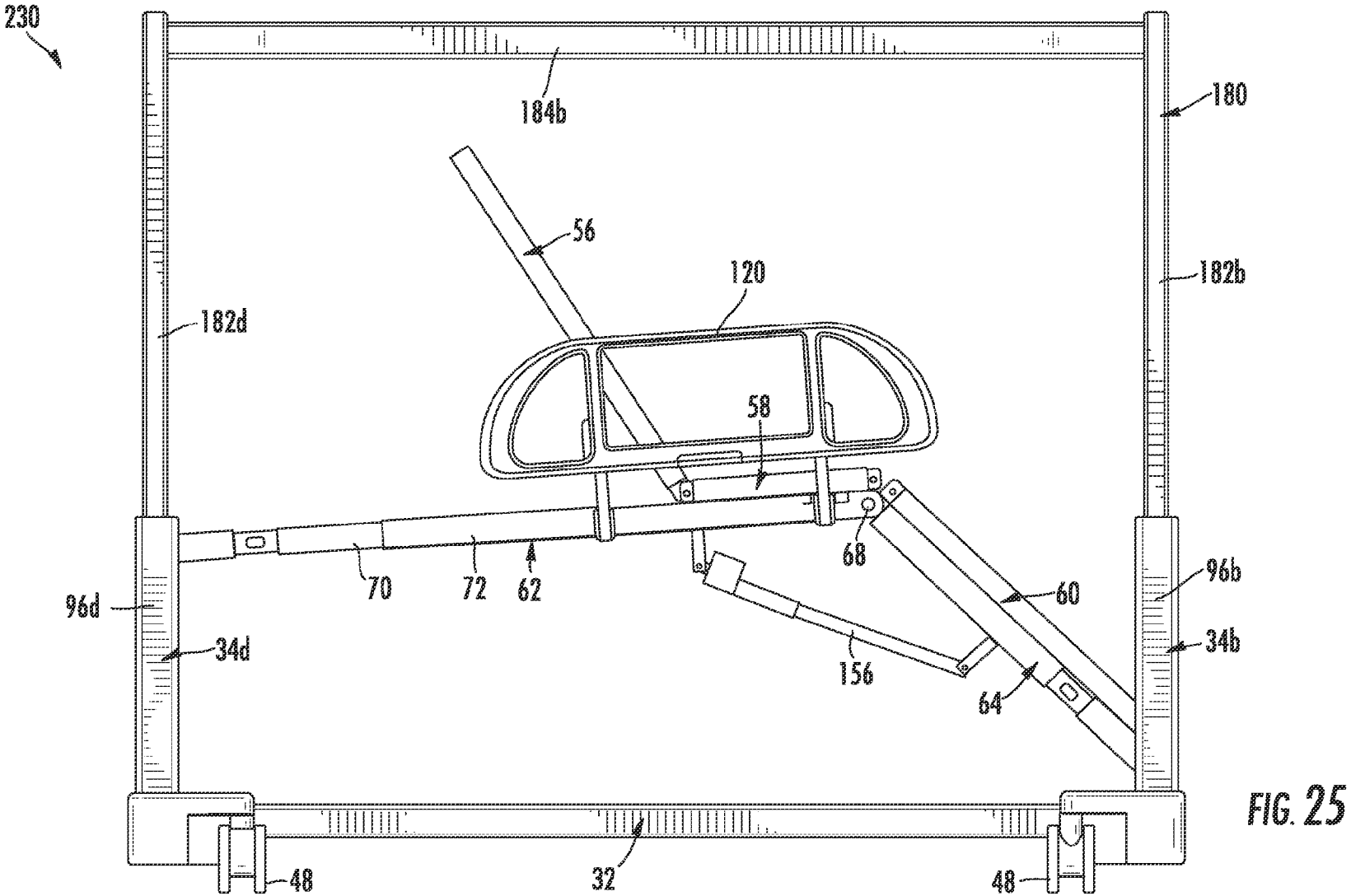
FIG. 25 is a side, elevational view of the patient support apparatus of FIG. 24.
Figure 26:
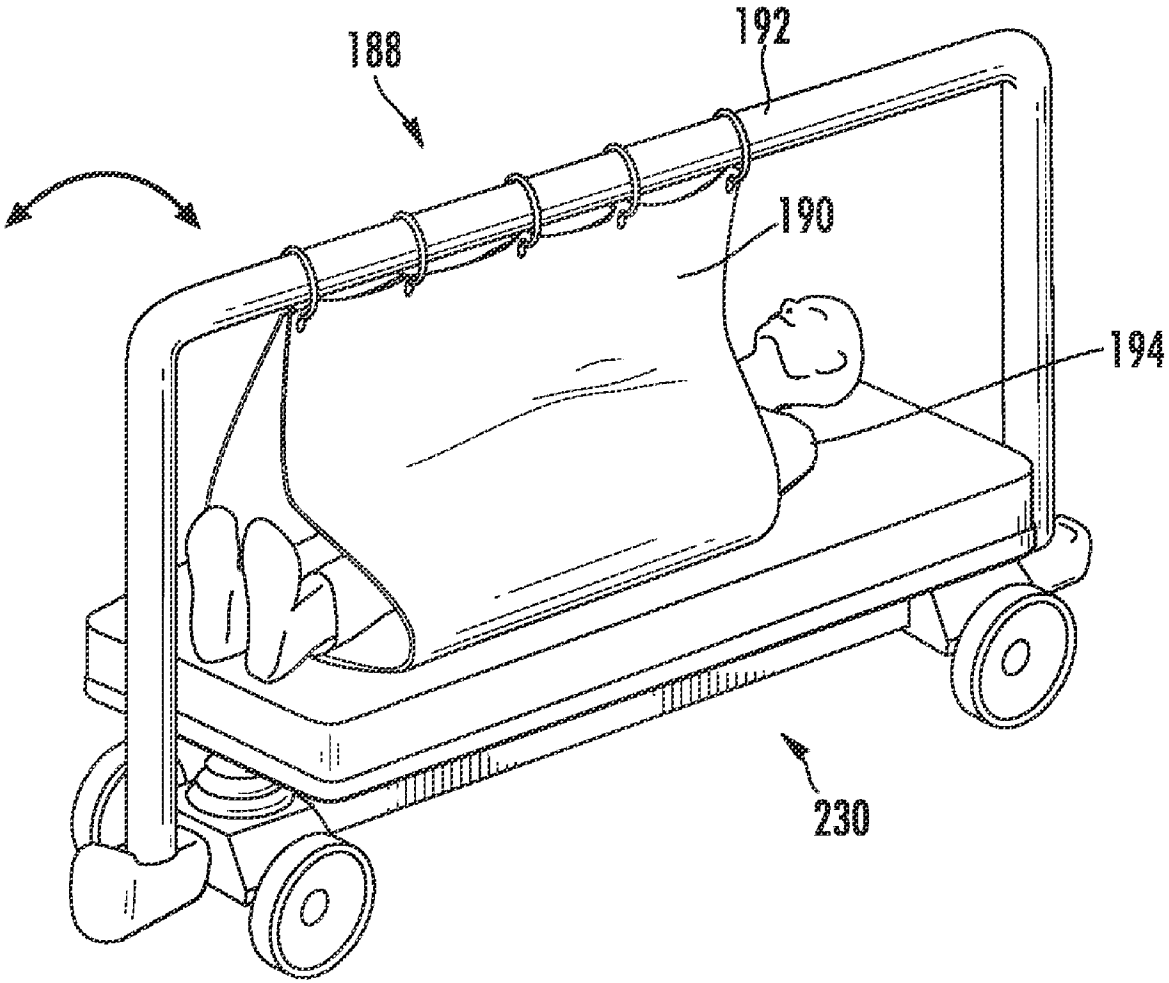
FIG. 26 is a perspective view of a patient support apparatus according to a third embodiment of the present invention in which an overhead support structure supporting a patient sleeve is attached.

FIGS. 24 and 25 illustrate patient support apparatus 230 with an optional overhead support structure 180 attached to the tops of each of posts 96*a-d*. Overhead support structure 180 includes four vertical beams 182*a-d*, a pair of longitudinal beams 184*a* & *b*, and a plurality of cross beams 186 interconnecting the longitudinal beams 184*a* & *b*. Overhead support structure 180 may be used to support a variety of different items, such as a privacy canopy that partially or wholly envelopes patient support apparatus 230 for purposes of giving the patient some privacy. Overhead support structure 180 may also be used to support an electronic display, such as a television, monitor, or screen, on which entertainment (such as television channels) may be displayed, or through which the Internet may be accessed, or through which video teleconferencing with remotely located medical personnel may take place. A camera may also optionally be positioned on overhead support structure 180 to allow video monitoring of the patient, or for video teleconferencing. Still further, overhead support structure 180 may be used to support or hold various medical equipment.

In one embodiment, illustrated in FIGS. 26 and 27*a-e*, overhead support structure 180 supports a patient proning apparatus 188. Patient proning apparatus 188 may be coupled together with either patient support apparatus 30 or patient support apparatus 230. Patient proning apparatus 188 includes a patient sleeve 190 that wraps under and around a patient in the manner illustrated more clearly in FIG. 26. Patient sleeve 190 is supported by an overhead beam 192 (FIG. 26), which may be hung from any of longitudinal beams 184 or cross beams 186 of overhead support structure 180. The manner in which patient proning apparatus 188 assists in the turning over of a patient is illustrated in greater detail in FIGS. 27*a-e*, which illustrate the motion of patient proning apparatus 188 and a patient 194 at different time intervals during the proning process.

Figure 27E:
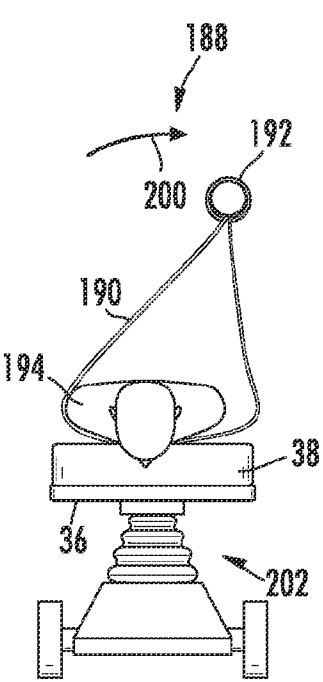
FIGS. 27*a-e* are front, elevational views of the patient support apparatus of FIG. 26 showing a sequence of movements of the patient support apparatus and patient sleeve that enables the patient to be turned from a face-up orientation to a face-down orientation, or vice versa.
Figure 27D:
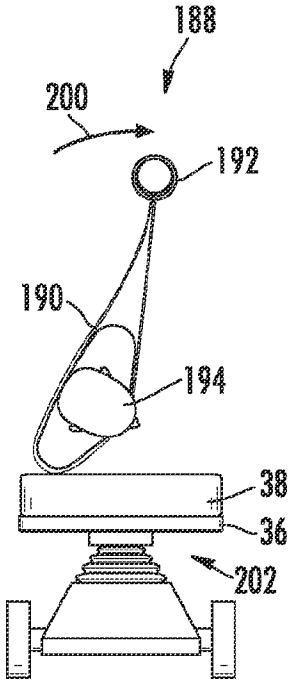
Figure 27C:
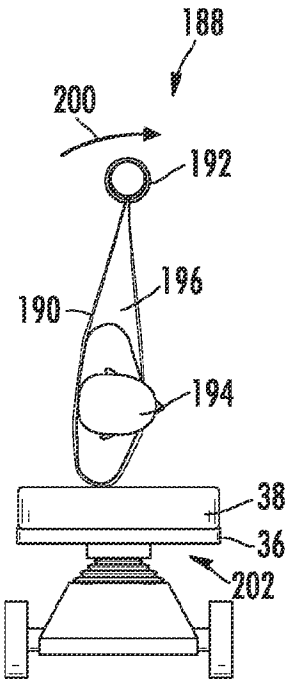
Figure 27B:
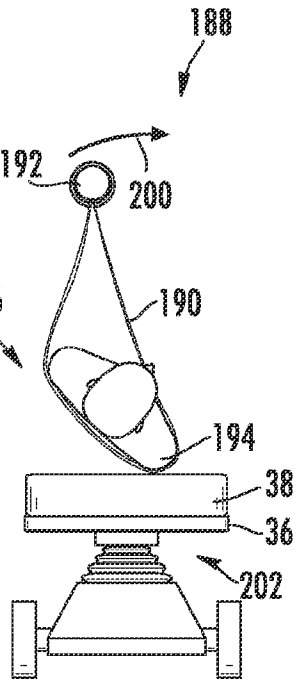
Figure 27A:
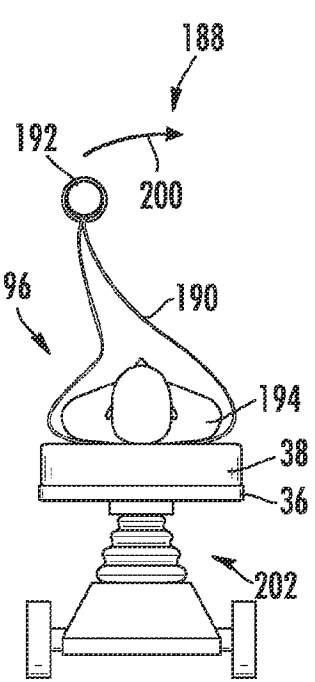

At an initial time period illustrated in FIG. 27*a*, overhead beam 192 is positioned at a left side 196 of patient 194. At a subsequent time period illustrated in FIG. 27*b*, the vertical distance between sleep surface 38 and overhead beam 192 is increased. This creates a rotating force that urges the patient 194 toward the orientation depicted in FIG. 27*b*. The increased vertical separation between overhead beam 192 and sleep surface 38 may be created either by lowering the support deck 36 or raising overhead beam 192, or a combination of both. As the vertical distance between sleep surface 38 and overhead beam 192 is increased, vertical beam 192 is moved rightward in the direction of arrow 200. FIG. 27*c* illustrates vertical beam 192 positioned above the longitudinal centerline of the patient support apparatus (which may be apparatus 30 or 230). Until overhead beam 192 reaches the longitudinal centerline of the patient support, the vertical distance between sleep surface 38 and overhead beam 192 may continue to be increased. After overhead beam 192 has reached the longitudinal centerline of the patient support and continues to move rightward (in FIGS. 27*a-e*), the vertical distance between sleep surface 38 and overhead beam 192 may begin to be decreased, either by lowering overhead beams 192, or raising support deck 36, or a combination of both. As illustrated in FIG. 27*e*, the continued rightward movement of overhead beam 192 and the continued decrease in the vertical separation between overhead beam 192 and sleep surface 38 eventually results in patient 194 being turned onto his or her stomach. After patient 194 has been rotated to the desired orientation, patient sleeve 190 can be disconnected from overhead beam 192 and either pulled out from underneath patient 194, or left thereunder. If left thereunder, sleeve 190 may be tucked into a suitable storage area, such as underneath deck 36, or elsewhere.

The sideward movement of overhead beam 192 may be powered by suitable motors positioned at appropriate locations on overhead support structure 180, or it may be done manually by a person grabbing sleeve 190 and exerting the proper sideward force. The up and down motion of overhead beam 192, if instituted, may also be done by appropriately positioned motors. If the vertical distance between patient support deck 36 and overhead beam 192 is altered by changing the height of support deck 36, any suitable height adjustment mechanism 202 may be used. Height adjustment mechanism 202 may include the elevation assemblies 34*a-d* described earlier, or proning apparatus 188 may be instituted on other patient supports that have different types of elevation adjustment mechanisms.

Figure 31:
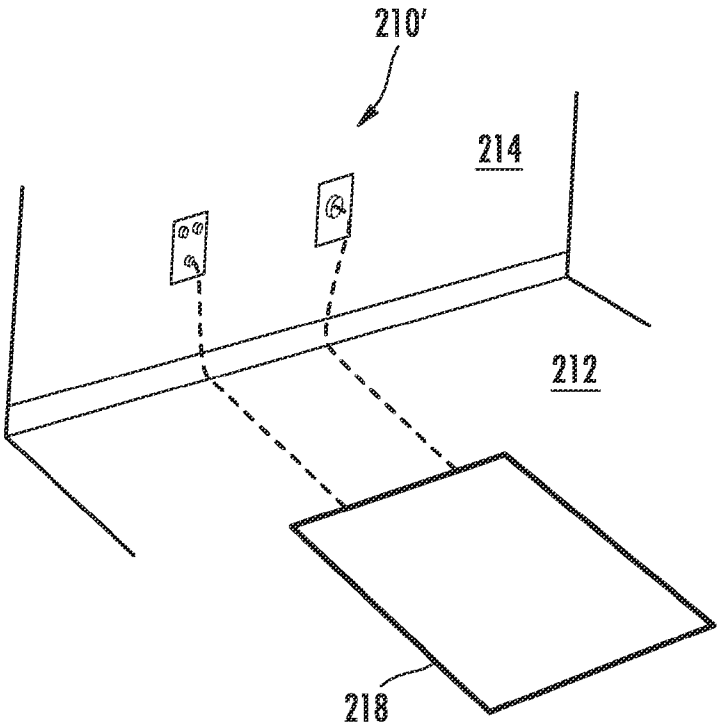
FIG. 31 is perspective view of an alternative inductive power station that may be used to wirelessly provide electrical power to any of the patient support apparatus embodiments described herein, as well as other patient support apparatuses.
Figure 30:
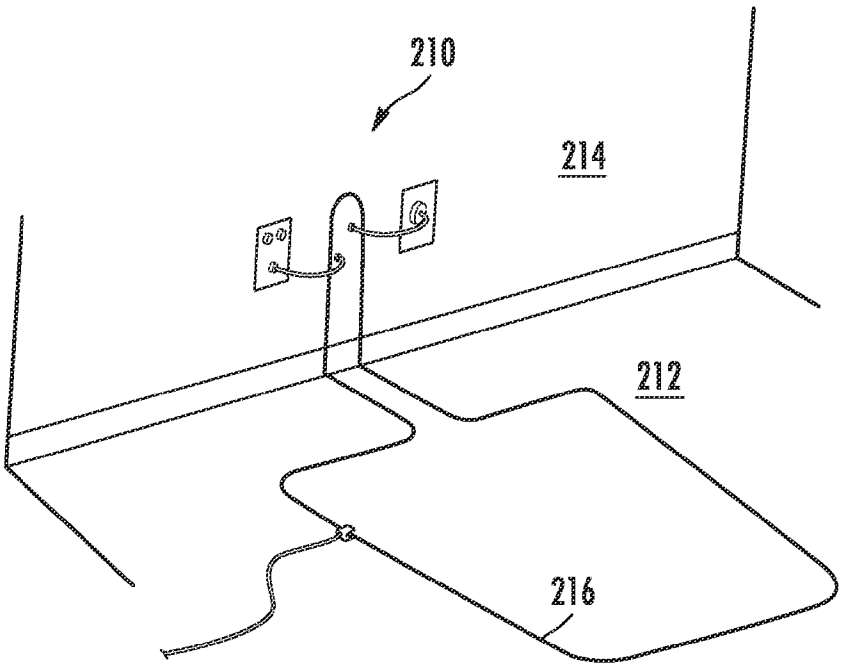
FIG. 30 is a perspective view of an inductive power station that may be used to wirelessly provide electrical power to any of the patient support apparatus embodiments described herein, as well as other patient support apparatuses.

The actuators included on either of patient support apparatuses 30 and 230 may be electrical actuators, although other types of actuators may also be used. The power supplied to the electrical actuators may come from one or more batteries positioned on the patient support apparatus, or from a wired electrical connection to a power source located remotely from the support apparatus. Alternatively, either of patient support apparatuses 30 and 230 can be modified to include an inductive power receptor (not shown) positioned on the underside of base 32 that inductively receives electrical power from an inductive power station 210 (FIGS. 30-31). Power station 210 of FIG. 30 may be positioned on a floor 212 adjacent a vertical wall 214. Power station 210 includes a coil 216 through which an alternating current is passed. Coil 216 may be positioned underneath a top surface of floor 212 so as to not be a trip hazard. When it is desirable to receive electrical power from power station 210, the patient support apparatus (e.g. 30 or 230) is wheeled to a location such that its inductive power receptor is positioned vertically above coil 216. The alternative current passed through coil 216 creates an electromagnetic wave that induces a voltage on a second coil within the inductive power receptor on the patient support apparatus. This induced voltage drives a current that may be used to power any of the various electrical systems on the patient support apparatus, or to re-charge a battery, or both.

In an alternative inductive power station 210', a conductive plate 218 is positioned on or underneath floor 212. Plate 218 is coupled to a source of alternating current such that it radiates an electromagnetic wave that induces a voltage on a coil or plate positioned on the patient support apparatus. Plate 218 or coil 216 can thus be used to wirelessly transmit power from stations 210 or 210' to a mobile patient support apparatus, such as patient support apparatus 30 or 30'.

FIGS. 33-37 illustrate a patient assist assembly 246 that may be coupled to overhead support structure 180 in order to assist a patient during ingress into, or egress out of, patient support apparatus 230. Patient assist assembly 246 includes an overhead beam 248, a sleeve 250, a patient grip 252, and a vertical support 253 (FIGS. 35-37) positioned away from patient support apparatus 230. FIGS. 33-37 generally illustrate the sequence of movements of patient assist assembly 246 when used to assist a patient out of patient support apparatus 230. When used to assist a patient into patient support apparatus 230, the sequence of movements would be reversed.

Figure 33:
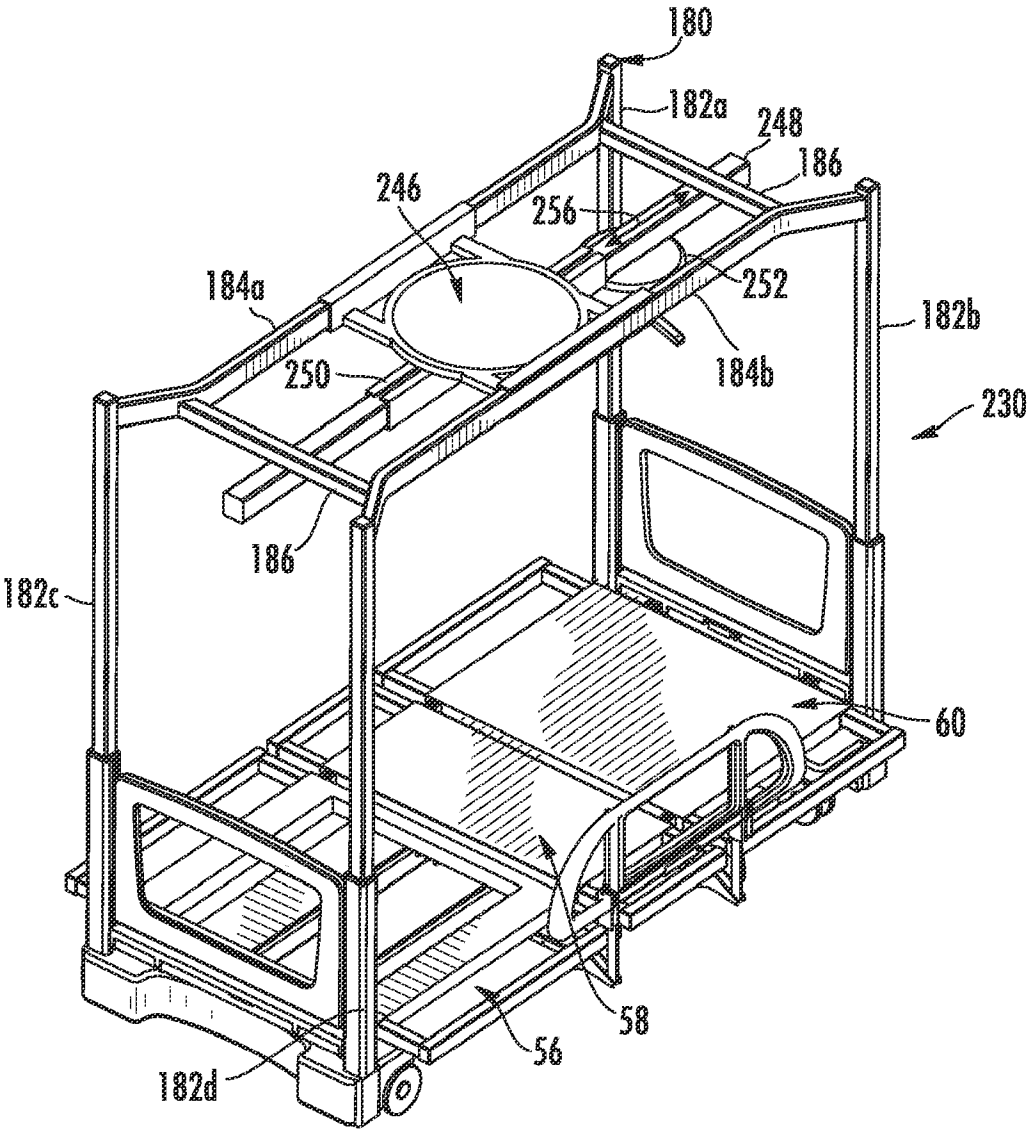
FIG. 33 is a perspective view of the patient support apparatus of FIG. 14 shown with a patient assist assembly attached to the overhead support structure.

As shown in FIG. 33, patient grip 252 is generally positioned above foot section 30 of patient support apparatus 30. Patient grip 252 includes one or more handlebars 254 (more clearly shown in FIGS. 35-37) which a patient may grasp onto when entering or exiting patient support apparatus 30. Patient grip 252 is supported by overhead beam 248 and is also moveable along overhead beam 248 in the manner indicated by double arrow 256 in FIG. 33. That is, patient grip 252 is moveable along overhead beam 248 in the longitudinal direction of beam 248. When a person is to exit from patient support apparatus 230, grip 252 is moved along beam 248 to a position generally above head section 56 of support deck 36. The movement of grip 252 along overhead beam 248 may be powered by any suitable actuator (not shown).

Figure 34:
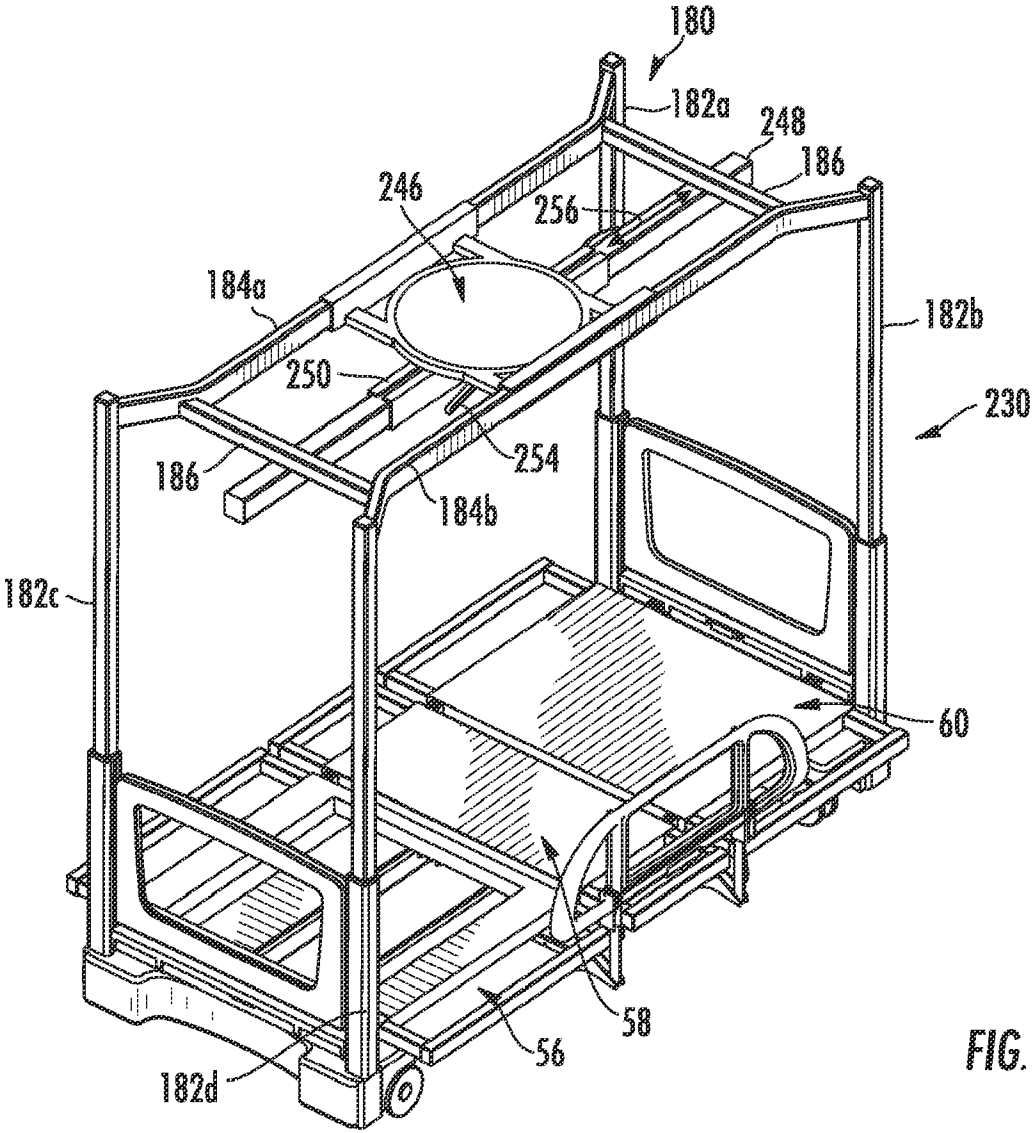
FIG. 34 is a perspective view similar to FIG. 33 illustrating a patient grip of the patient assist assembly moved to a central region.
Figure 35:
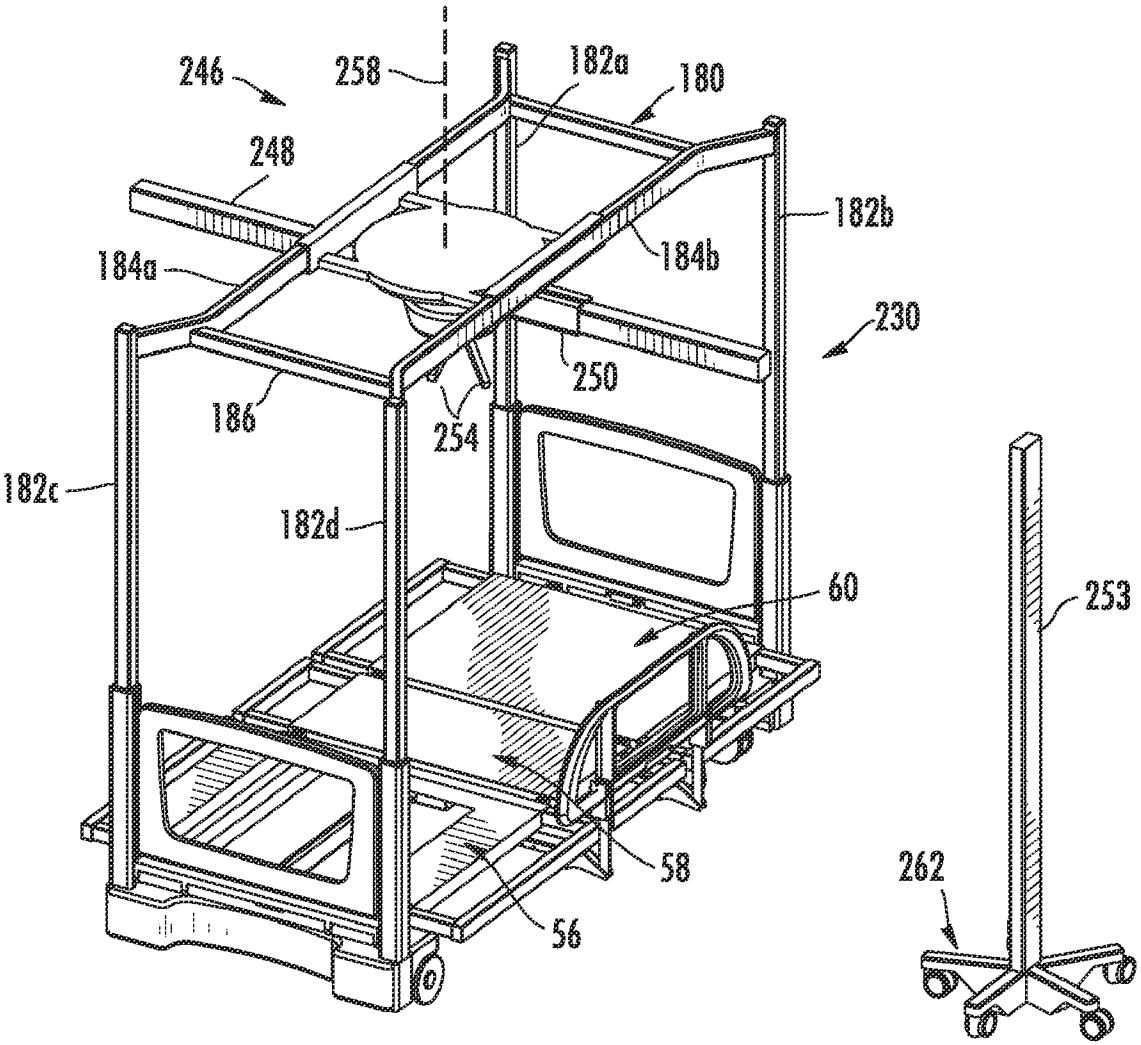
FIG. 35 is a perspective view similar to FIG. 34 illustrating an overhead beam of the patient assist assembly rotated.
Figure 36:
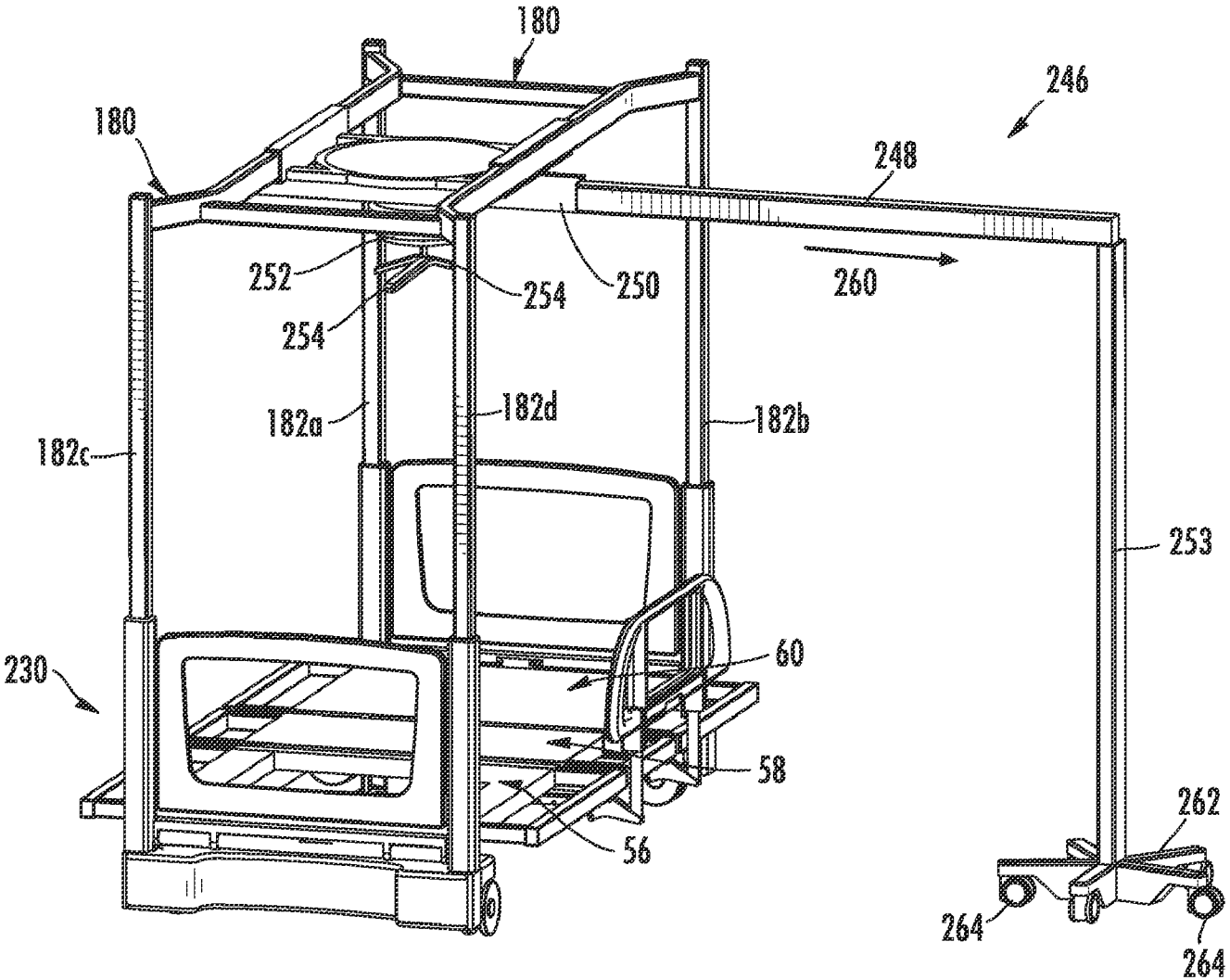
FIG. 36 is a perspective view similar to FIG. 35 illustrating the overhead beam supported on one end by a vertical support.

After grip 252 has been moved to a location above head section 56, the patient grasps one or more of the handlebars 254 and uses the handlebars to pull him or herself upward to the best of their ability. Thereafter, the patient continues to hold onto the handlebars as grip 252 is moved toward a central region above patient support apparatus 230 (such as shown in FIG. 34). After grip 252 has been moved to the central region shown in FIG. 34, overhead beam 248 is rotated about a vertical axis 258 (FIG. 35). In FIG. 35, this rotation is illustrated as a rotation of approximately ninety degrees, although it will be understood that the use of patient assist assembly 246 can utilize other amounts of rotation. After whatever desirably rotation amount has been achieved, overhead beam 248 moves longitudinally in the direction indicated by arrow 260 (FIG. 36) within sleeve 250. This movement continues until beam 248 reaches vertical support 253. When vertical beam 248 reaches vertical support 253, it is coupled thereto. Any suitable mechanism may be used to releasably secure beam 248 to vertical support 253. Vertical support 253 may be positioned on a pedestal 262 having one or more wheels 264 that facilitate moving vertical support 253 to the appropriate location for coupling with vertical beam 248.

Figure 37:
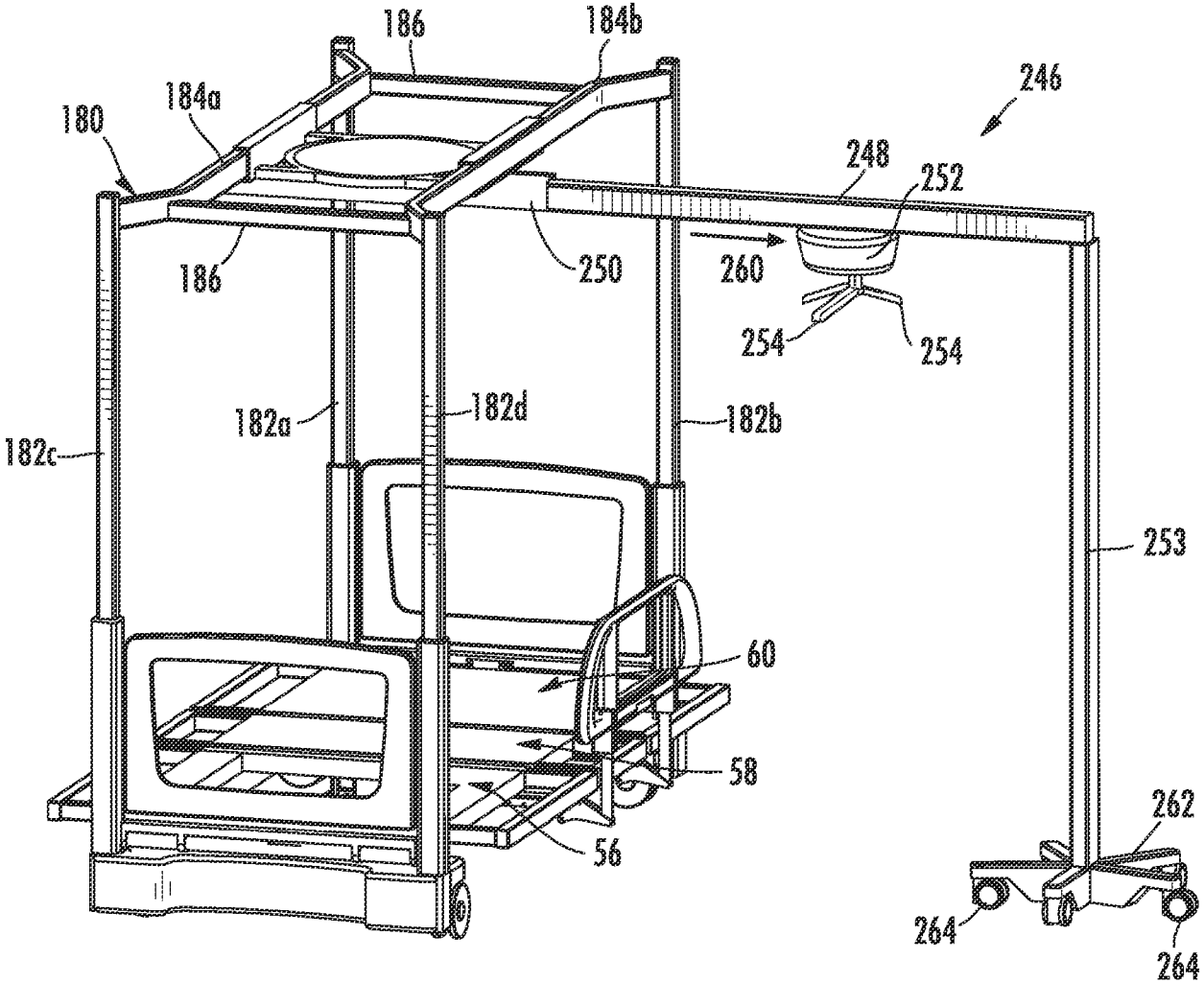
FIG. 37 is a perspective view similar to FIG. 36 illustrating the patient grip of the patient assist assembly moved toward the vertical support

After beam 248 has been coupled to vertical support 253, grip 252 is moved along the length of beam 248 in the same direction as arrow 260. FIG. 37 illustrates grip 252 after it has been moved to a location away from patient support apparatus 230. While grip 252 moves along beam 248, the patient continues to grip handlebars 254. The movement of grip 252 as the patient is gripping handlebars 254 allows the patient to more easily assist in the transfer of him or herself out of patient support apparatus 230. Grip 252 thus provides a mobile support for the patient to grasp during ingress and egress that moves with the patient and assists the patient in a better manner than prior methods of assisting the patient.

In either of patient support apparatuses 30 and 230, elevation assemblies 34*a-d* are positioned outside of a perimeter of support deck 36 (i.e. the perimeter of support deck 36 when viewing support deck 36 in a plan view). This ensures that the physical space occupied by elevation assemblies 34*a-d* does not limit the downward movement of support deck 36, which happens in many prior art patient supports where the elevation assemblies are positioned underneath the support deck and thereby occupy physical space that the support deck might otherwise be lowered into. Stated alternatively, the footprint of deck 36 (i.e. space underneath support deck 36) is generally free of any obstructions other than base 32 (see, e.g. FIG. 2). Support deck 36 can thus be lowered all the way down to base 32. Further, because there is no separate horizontal frame between support deck 36 and base 32, support deck 36 can be lowered to a lower elevation than would be possible if such a frame were positioned between support deck 36 and base 32.

While the present invention has been described above with respect to patient support apparatuses 30 and 230, it will be understood that any of the features of support apparatus 30 can be incorporated into support apparatus 230, or vice versa. For example, the support deck width extenders 232 of patient support apparatus 230 can be incorporated into support apparatus 30. Also, the overhead support structure 180 of support apparatus 230 can be mounted to the posts 96 of patient support apparatus 30. Still further, the proning apparatus 188 can be used with patient support apparatus 30 as well as patient support apparatus 230. Still other features can be switched and combined from one support apparatus to another.

It will also be understood that a variety of different modifications can be made to various patient support apparatuses described herein. As one example, the number of elevation assemblies 34 can be varied from the four shown in the accompanying drawings. For instance, it would be possible to include only a single elevation assembly at each end of the patient support apparatus. Still further, it would be possible to modify the vertical-threaded-shaft-and-collar construction of elevation assemblies 34 as described previously to incorporate a different design for raising and lowering the patient support deck 36. Such a modified design might include hydraulics, pneumatics, electrical motors configured with one or more chains, or a variety of other types of mechanisms capable of raising and lowering support deck 36.

Additionally, it will be understood that any of the patient support apparatuses 30 and 230 described herein may be modified to include any of the features, structures, or devices, either alone or in any combination, that are described in either of the two provisional patent applications to which this application claims priority.

While the present invention has been described herein in reference to the various embodiments illustrated in the attached drawings, it will be understood by those skilled in the art that the present invention can be modified to include any and all variations that are within the spirit and scope of the following claims.

What is claimed is:

1. A patient support apparatus comprising:

a base having a foot end and a head end;

a first elevation assembly positioned at the head end of said base;

a second elevation assembly positioned at the foot end of said base;

a support deck adapted to support a patient, said first and second elevation assemblies being coupled to said support deck such that said first and second elevation assemblies can raise and lower said support deck with respect to said base;

said support deck including a first rail extending from said first elevation assembly to an intermediate location between said foot end and said head end of said base, said first rail having a head end pivotably coupled to said first elevation assembly;

said support deck further including a second rail extending from said second elevation assembly to said intermediate location, said second rail being pivotably coupled to said first rail, and said second rail having a foot end pivotably coupled to said second elevation assembly;

at least one of said first and second rails including a beam and a sleeve, said beam and said sleeve each having longitudinal extents that are parallel to each other, said beam and said sleeve adapted to move with respect to each other such that a length of said at least one of said first and second rails can be extended and shortened;

an actuator adapted to pivot said first rail with respect to said second rail such that said beam and said sleeve move with respect to each other and a horizontal distance between said head end of said first rail and said foot end of said second rail remains constant while said first rail pivots with respect to said second rail;

said support deck including a head section having a head end and a foot end, said head section being pivotably supported by said first rail at a location adjacent said foot end of said head section whereby said head end of said head section is pivotable toward and away from said first rail; and wherein one of said seat section and said head section is mounted to said beam and the other of said seat section and said head section is mounted to said sleeve, said seat section and said head section moving away from each other as said first and second rails are pivoted away from a flat orientation in which said first and second rails are parallel to each other.

2. The patient support apparatus of claim 1 further including a plurality of generally planar side rails, each said side rail being pivotably supported by one of said first and second rails such that said side rails are pivotable between a first orientation and a second orientation wherein said first orientation is perpendicular to said second orientation.

3. The patient support apparatus of claim 2 wherein said first orientation is a vertical orientation in which said generally planar side rails extend in a direction parallel to a line extending from said foot end of said base toward said head end of said base, and said second orientation is a vertical orientation in which said generally planar side rails extend in a direction perpendicular to the line extending from said foot end of said base toward said head end of said base.

4. The patient support apparatus of claim 2 wherein said first orientation is a vertical orientation and said second orientation is a horizontal orientation.

5. A patient support apparatus comprising:

a base having a foot end and a head end;

a first elevation assembly positioned at the head end of said base;

a second elevation assembly positioned at the foot end of said base;

a support deck adapted to support a patient, said first and second elevation assemblies being coupled to said support deck such that said first and second elevation assemblies can raise and lower said support deck with respect to said base;

said support deck including a first rail extending from said first elevation assembly to an intermediate location between said foot end and said head end of said base, said first rail having a head end pivotably coupled to said first elevation assembly;

said support deck further including a second rail extending from said second elevation assembly to said intermediate location, said second rail being pivotably coupled to said first rail, and said second rail having a foot end pivotably coupled to said second elevation assembly;

at least one of said first and second rails including a beam and a sleeve, said beam and said sleeve each having longitudinal extents that are parallel to each other, said beam and said sleeve adapted to move with respect to each other such that a length of said at least one of said first and second rails can be extended and shortened;

an actuator adapted to pivot said first rail with respect to said second rail such that said beam and said sleeve move with respect to each other and a horizontal distance between said head end of said first rail and said foot end of said second rail remains constant while said first rail pivots with respect to said second rail; and a sleep surface having a foot end, a head end, and a pair of sides, said sleep surface being positioned on top of said support deck and including a strip along at least one of said sides, said strip being foldable between a folded position and an unfolded position, wherein when said strip is in the unfolded position, said sleep surface has a distance between said pair of sides greater than the distance between said pair of sides when said strip is in the folded position.

6. The patient support apparatus of claim 5 wherein said strip includes a stiff portion, said stiff portion positioned at an edge of said sleep surface when said strip is unfolded, and said stiff portion positioned along a bottom of said sleep surface when said strip is folded.

7. A patient support apparatus comprising:

a base having a foot end and a head end;

a first elevation assembly positioned at the head end of said base;

a second elevation assembly positioned at the foot end of said base;

a support deck adapted to support a patient, said first and second elevation assemblies being coupled to said support deck such that said first and second elevation assemblies can raise and lower said support deck with respect to said base, wherein said support deck defines a footprint w both said first elevation assembly and said second elevation assembly are positioned outside of said footprint;

said support deck including a first rail extending from said first elevation assembly to an intermediate location between said foot end and said head end of said base, said first rail having a head end pivotably coupled to said first elevation assembly;

said support deck further including a second rail extending from said second elevation assembly to said intermediate location, said second rail being pivotably coupled to said first rail, and said second rail having a foot end pivotably coupled to said second elevation assembly;

at least one of said first and second rails including a beam and a sleeve, said beam and said sleeve each having longitudinal extents that are parallel to each other, said beam and said sleeve adapted to move with respect to each other such that a length of said at least one of said first and second rails can be extended and shortened;

an actuator adapted to pivot said first rail with respect to said second rail such that said beam and said sleeve move with respect to each other and a horizontal distance between said head end of said first rail and said foot end of said second rail remains constant while said first rail pivots with respect to said second rail;

a plurality of generally planar side rails, each said side rail being pivotably supported by one of said first and second rails such that said side rails are pivotable between a first orientation and a second orientation wherein said first orientation is perpendicular to said second orientation;

wherein each of said side rails further includes an extension, said extension being supported by one of said first and second rails and movable between an extended position and a retracted position, said side rails being positioned closer to a longitudinal center line of said support deck when in said retracted position than when in said extended position.

8. The patient support apparatus of claim 7 wherein said side rails are further adjustable between a raised position and a lowered position, said side rails define a first plane in said raised position and a second plane in said lowered position, and said first and second planes are parallel to each other.

9. A patient support apparatus comprising:

a base having a foot end and a head end;

a first elevation assembly positioned at the head end of said base;

a second elevation assembly positioned at the foot end of said base;

a support deck adapted to support a patient, said first and second elevation assemblies being coupled to said support deck such that said first and second elevation assemblies can raise and lower said support deck with respect to said base;

said support deck including a first rail extending from said first elevation assembly to an intermediate location between said foot end and said head end of said base, said first rail having a head end pivotably coupled to said first elevation assembly;

said support deck further including a second rail extending from said second elevation assembly to said intermediate location, said second rail being pivotably coupled to said first rail, and said second rail having a foot end pivotably coupled to said second elevation assembly;

at least one of said first and second rails including a beam and a sleeve, said beam and said sleeve each having longitudinal extents that are parallel to each other, said beam and said sleeve adapted to move with respect to each other such that a length of said at least one of said first and second rails can be extended and shortened;

an actuator adapted to pivot said first rail with respect to said second rail such that said beam and said sleeve move with respect to each other and a horizontal distance between said head end of said first rail and said foot end of said second rail remains constant while said first rail pivots with respect to said second rail;

wherein said actuator includes:

a threaded, horizontal shaft oriented perpendicular to an imaginary line running from said head end of said base to said foot end of said base;

a first set of arms, each of the arms in said first set of arms including a first end threadingly mated to said horizontal shaft and a second end pivotably coupled to an underside of said foot section; and a second set of arms, each of said arms in said second set of arms including a first end threadingly mated to said horizontal shaft and a second end pivotably coupled to said support deck at a location under said seat section.

10. A patient support apparatus comprising:

a base having a foot end and a head end;

a first elevation assembly positioned at the head end of said base;

a second elevation assembly positioned at the foot end of said base;

a support deck adapted to support a patient, said first and second elevation assemblies being coupled to said support deck such that said first and second elevation assemblies can raise and lower said support deck with respect to said base;

said support deck including a first rail extending from said first elevation assembly to an intermediate location between said foot end and said head end of said base, said first rail having a head end pivotably coupled to said first elevation assembly;

said support deck further including a second rail extending from said second elevation assembly to said intermediate location, said second rail being pivotably coupled to said first rail, and said second rail having a foot end pivotably coupled to said second elevation assembly;

at least one of said first and second rails including a beam and a sleeve, said beam and said sleeve each having longitudinal extents that are parallel to each other, said beam and said sleeve adapted to move with respect to each other such that a length of said at least one of said first and second rails can be extended and shortened; and an actuator adapted to pivot said first rail with respect to said second rail such that said beam and said sleeve move with respect to each other and a horizontal distance between said head end of said first rail and said foot end of said second rail remains constant while said first rail pivots with respect to said second rail; and wherein said support deck further includes a length extender movingly coupled to said foot section, said length extender movable between a retracted position in which a length of said support deck has a first value, and an extended position in which a length of said support deck has a second value greater than said first value.

11. A patient support apparatus comprising:

a base having a head end and a foot end;

a support deck adapted to support a patient and having an outer perimeter, said support deck including a foot section, a seat section, and a head section, both said seat section and said head section pivotable between generally horizontal orientations and raised orientations;

a first elevation assembly positioned at the head end of said base;

a second elevation assembly positioned at the foot end of said base, said first and second elevation assemblies being coupled to said support deck such that said first and second elevation assemblies can raise and lower said support deck with respect to said base, said first and second elevation assemblies being positioned outside a footprint of said support deck wherein said footprint is defined by a vertical downward projection of said perimeter onto said base; and a shear reduction assembly adapted to increase a distance between said head section and said seat section when said head section and said seat section are pivoted from their respective generally horizontal orientations to their respective raised orientations.

12. The patient support apparatus of claim 11 further including an actuator, said actuator including:

a threaded, horizontal shaft oriented perpendicular to an imaginary line running from said head end of said base to said foot end of said base;

a first set of arms, each of the arms in said first set of anus including a first end threadingly mated to said horizontal shaft and a second end pivotably coupled to an underside of said foot section; and a second set of anus, each of said arms in said second set of anus including a first end threadingly mated to said horizontal shaft and a second end pivotably coupled to said support deck at a location under said seat section.

13. The patient support apparatus of claim 11 further including a plurality of generally planar side rails attached to an underside of said support deck, each of said side rails being pivotable between a first orientation and a second orientation perpendicular to said first orientation.

14. The patient support apparatus of claim 11 further including a sleep surface having a foot end, a head end, and a pair of sides, said sleep surface being positioned on top of said support deck and including a strip along at least one of said sides, said strip being foldable between a folded position and an unfolded position, wherein when said strip is in the unfolded position, said sleep surface has a distance between said pair of sides greater than the distance between said pair of sides when said strip is in the folded position.

15. The patient support apparatus of claim 11 wherein said support deck includes:

a first rail extending from said head end of said base to an intermediate location between said foot end and said head end of said base, said first rail having a head end pivotably coupled to said first elevation assembly; and a second rail extending from said foot end of said base to said intermediate location, said second rail being pivotably coupled to said first rail, and said second rail having a foot end pivotably coupled to said second elevation assembly;

wherein at least one of said first and second rails includes a beam and a sleeve, said beam and said sleeve each having longitudinal extents that are parallel to each other, said beam and said sleeve adapted to slide with respect to each other such that a length of said at least one of said first and second rails can be extended and shortened.

16. The patient support apparatus of claim 11 further including:

a sleep surface positioned on top of said support deck;

a side rail attached to said support deck along a side of said head section;

a headboard attached to said support deck at a location adjacent said head section, said headboard being oriented generally perpendicular to said side rail;

a vertical post mounted to said base adjacent said head end of said base, said post positioned at corner wherein a horizontal distance between said post and said headboard is less than or equal to 2.5 inches, and a horizontal distance between said post and said side rail is less than or equal to 2.5 inches.

17. The patient support apparatus of claim 16 wherein said post extends upwards to a height greater than a maximum height of said sleep surface, said maximum height of said sleep surface being defined by a vertical maximum of said first elevation assembly.

18. The patient support apparatus of claim 17 wherein said post houses a first vertical threaded shaft and a first threaded collar in engagement with said first vertical threaded shaft, said first threaded collar adapted to move vertically upward or downward when said first threaded collar and said first threaded shaft engaged with said first threaded collar rotate with respect to each other.

19. The patient support apparatus of claim 1 wherein said patient support apparatus is a hospital bed having a mattress supported upon said deck.

20. The patient support apparatus of claim 11 wherein said patient support apparatus is a hospital bed having a mattress supported upon said deck.

* * * * *

UNITED STATES PATENT AND TRADEMARK OFFICE

CERTIFICATE OF CORRECTION

PATENT NO. : 8,056,163 B2
APPLICATION NO. : 11/769959
DATED : November 15, 2011
INVENTOR(S) : Guy Lemire, Martin W. Stryker and Pascal Castonguay It is certified that error appears in the above-identified patent and that said Letters Patent is hereby corrected as shown below:

Col 20, Claim 7, Line 3: the word “w” should read “wherein”

Col 22, Claim 12, Line 24: the word “anus” should read “arms”

Col 22, Claim 12, Line 28: the word “anus” should read “arms”

Col 22, Claim 12, Line 29: the word “anus” should read “arms”

Signed and Sealed this
First Day of January, 2013

David J. Kappos

David J. Kappos
*Director of the United States Patent and Trademark Office*